US011414247B1

(12) United States Patent
Philips et al.

(10) Patent No.: US 11,414,247 B1
(45) Date of Patent: Aug. 16, 2022

(54) AUTOMATIC PRODUCT PRESENTING BOX

(71) Applicant: Packaging Corporation of America, Lake Forest, IL (US)

(72) Inventors: Nicholas A. Philips, Sugar Grove, IL (US); James D. Southwell, Long Grove, IL (US)

(73) Assignee: Packaging Corporation of America, Lake Forest, IL (US)

( * ) Notice: Subject to any disclaimer, the term of this patent is extended or adjusted under 35 U.S.C. 154(b) by 0 days.

(21) Appl. No.: 16/998,138

(22) Filed: Aug. 20, 2020

Related U.S. Application Data

(60) Provisional application No. 62/889,469, filed on Aug. 20, 2019.

(51) Int. Cl.
*B65D 43/24* (2006.01)
*B65D 43/16* (2006.01)

(52) U.S. Cl.
CPC ..... *B65D 43/24* (2013.01); *B65D 43/162* (2013.01); *B65D 2251/1033* (2013.01); *B65D 2543/00537* (2013.01)

(58) Field of Classification Search
CPC ..... B65D 43/24; B65D 43/162; B65D 43/16; B65D 2251/1033; B65D 2543/00537; B65D 51/249; B65D 77/24; B65D 5/52; B65D 5/524; B65D 5/5213; B65D 5/5233; B65D 5/526; B65D 5/5206; B65D 83/005; A45C 11/00; A45C 11/24; G09F 5/00; G09F 5/02
USPC ..... 206/6.1, 320, 701, 722–723, 736, 747, 206/755–756, 761–762, 764–765, 768, 206/80, 45.2, 45.21, 45.24; 229/147, 149, 229/164, 178, 120.18, 120.21, 114, 103, 229/104, 154, 117.12
See application file for complete search history.

(56) References Cited

U.S. PATENT DOCUMENTS 1,029,096 A * 6/1912 Wolf ..... A45C 5/00 206/749
1,352,759 A * 9/1920 Markert ..... B65D 5/5014 206/589
1,486,145 A * 3/1924 Johnson ..... B65D 5/5286 206/486
1,542,285 A * 6/1925 Campbell ..... B65D 5/5206 206/45.21
1,701,065 A * 2/1929 Darragh ..... B65D 5/5206 206/45.22

(Continued)

*Primary Examiner* — Chun Hoi Cheung
*Assistant Examiner* — Brijesh V. Patel
(74) *Attorney, Agent, or Firm* — Klarquist Sparkman, LLP

(57) ABSTRACT

A container can include a container portion, a cover coupled to the container portion and configured to pivot between a closed position and an open position, and a product platform configured to receive a product. The product platform can be coupled to the container portion and configured to pivot between a first position in which the product platform is received within the container portion and a second position in which the product platform is inclined at least partially out of the container portion. The cover is configured to engage the product platform such that when the cover is pivoted from the closed position to the open position in a first direction, motion of the cover pivots the product platform in a second direction from the first position to the second position such that the product platform is inclined at least partially out of the container portion.

21 Claims, 18 Drawing Sheets

(56) References Cited

U.S. PATENT DOCUMENTS 1,726,732 A 9/1929 Doran
2,131,093 A 9/1938 Cage
2,167,947 A * 8/1939 Hayes ..... B65D 5/5206 206/45.21
2,219,039 A 10/1940 Young
2,342,894 A 2/1944 Quartin
2,370,967 A * 3/1945 Junkin ..... A45C 11/04 206/6
2,375,843 A * 5/1945 Gottlieb ..... B65D 5/5021 206/784
2,511,211 A * 6/1950 Klein ..... A47F 7/03 206/754
2,585,361 A 2/1952 Williamson
2,657,793 A 11/1953 Goldshine
2,673,642 A * 3/1954 Smalley ..... A47F 7/03 206/754
2,675,911 A * 4/1954 Thurston ..... A47F 7/03 206/754
2,843,307 A * 7/1958 Goltz ..... B65D 5/0015 206/509
2,860,767 A 11/1958 Shiffman
2,924,371 A * 2/1960 Frankenstein ..... B65D 5/2009 206/776
3,095,086 A * 6/1963 Berg ..... B65D 5/5021 206/784
3,401,865 A * 9/1968 Kjell ..... B65D 5/16 229/159
3,826,420 A * 7/1974 Bamburg ..... B65D 5/22 229/102
3,899,119 A * 8/1975 Roccaforte ..... B65D 5/6664 206/562
3,900,100 A * 8/1975 Girman ..... B65D 5/5021 206/749
4,265,393 A * 5/1981 Orchard ..... B65D 5/6652 229/103.3
4,413,726 A * 11/1983 Davidson ..... B65D 5/4229 206/45.23
4,433,778 A * 2/1984 Maio ..... B65D 5/5206 206/45.21
4,773,542 A * 9/1988 Schillinger ..... B65D 5/4266 229/145
4,896,766 A 1/1990 Paley
4,957,237 A * 9/1990 Madonna ..... B65D 5/48018 229/120
5,002,188 A * 3/1991 Dickie ..... B65D 5/5021 206/589
5,007,530 A * 4/1991 Weismantel ..... A01K 1/0125 119/168
5,078,268 A * 1/1992 Olson ..... A45C 11/18 206/39
5,096,055 A 3/1992 Opper
5,222,657 A * 6/1993 Holland, Jr. ..... B65D 5/2009 206/45.29
5,427,232 A * 6/1995 Buch ..... B65D 5/2009 206/45.29
5,445,314 A * 8/1995 Newsome ..... B65D 5/48014 229/120.21
5,452,793 A * 9/1995 DiMeo, Jr. ..... A45C 11/18 206/39
5,682,999 A * 11/1997 Larson ..... A63H 3/18 206/45.28
5,950,912 A * 9/1999 Economopoulos .. B65D 5/5021 229/120.32
6,915,949 B1 * 7/2005 Economopoulos .. B65D 5/4295 229/120.32
7,234,629 B2 * 6/2007 Ho ..... B65D 5/365 229/117.07
7,264,123 B2 * 9/2007 Reed ..... B65D 5/22 206/472
7,455,182 B2 11/2008 Merckell
D587,998 S * 3/2009 Kaisanlahti ..... B65D 5/5213 D9/433
7,533,774 B2 * 5/2009 Zimmerman ..... A45C 11/24 206/387.14
D594,743 S * 6/2009 Lukka ..... B25H 3/003 D9/433
7,661,536 B2 * 2/2010 Voswinkel ..... B65D 5/10 206/762
8,181,788 B2 * 5/2012 Meneses ..... B65D 5/6667 206/765
8,474,619 B1 * 7/2013 Chrisman ..... B65D 5/5213 206/449
8,627,958 B2 * 1/2014 McDonald ..... B65D 5/321 206/583
8,651,348 B2 * 2/2014 Meng ..... B25H 3/003 224/245
8,783,549 B2 * 7/2014 Jo ..... B31B 50/26 229/117.08
9,180,997 B2 * 11/2015 Melistas ..... B65D 5/5016
9,371,151 B2 6/2016 Nadeau
9,394,099 B2 * 7/2016 Kimhi ..... B65D 85/36
9,533,791 B2 * 1/2017 Fath ..... B65D 5/26
9,642,425 B2 * 5/2017 Tseng ..... B65D 81/113
9,932,162 B2 * 4/2018 Stack, Jr. ..... B65D 65/40
9,988,193 B1 * 6/2018 Koeppel ..... B65D 51/249
10,384,861 B2 8/2019 Chatelain
2003/0234252 A1 * 12/2003 Howard ..... B65D 5/28 220/62.1
2004/0124236 A1 * 7/2004 Howard ..... B65D 5/5021 229/145
2004/0178253 A1 * 9/2004 Stier ..... B65D 5/10 229/120.14
2008/0054057 A1 * 3/2008 Chang ..... B65D 5/22 229/120.18
2015/0114880 A1 4/2015 Hough et al.
2017/0042311 A1 * 2/2017 Wilder ..... A61K 8/0208
2019/0016168 A1 * 1/2019 Nelson ..... B65D 5/4204
2019/0092517 A1 3/2019 Chou et al.
2019/0168908 A1 * 6/2019 Lee ..... B65D 5/5021

* cited by examiner

AUTOMATIC PRODUCT PRESENTING BOX

CROSS-REFERENCE TO RELATED APPLICATION

This application claims the benefit of U.S. Provisional Patent Application No. 62/889,469, filed Aug. 20, 2019, which is incorporated by reference herein in its entirety.

FIELD

The present disclosure pertains to boxes configured to automatically move a product from a first position to a second display position when the box is opened.

BACKGROUND

Part of the experience of receiving a package is the excitement or anticipation of opening the package and viewing the product contained in the package for the first time. To heighten the experience, the product can be positioned in a manner such that is easily viewed and/or accessed by the user when opening the box. However, such a product position or orientation may not be suitable for shipping the product because the package may be overly bulky and/or the product may be poorly supported within the box and thus prone to damage. Accordingly, there exists a need for containers or boxes that can protect the product during shipping and heighten the user's experience of opening the box.

SUMMARY

Disclosed herein are examples of containers (e.g., boxes) that can be configured to move a portion of the container holding a product therein from a first position where the product is arranged within an interior of the container to a second, display position where the product is lifted away from the interior of the container, when the container is opened.

In one representative embodiment, a container comprises a container portion comprising a plurality of walls. The container further comprises a cover coupled to the container portion and configured to pivot between a closed position and an open position. The container further comprises a product platform configured to receive a product, the product platform being coupled to the container portion and configured to pivot between a first position in which the product platform is received within the container portion and a second position in which the product platform is inclined at least partially out of the container portion. The cover is configured to engage the product platform such that when the cover is pivoted from the closed position to the open position in a first direction, motion of the cover pivots the product platform in a second direction from the first position to the second position such that the product platform is inclined at least partially out of the container portion at an angle relative to a base wall of the container portion.

In some embodiments, the cover comprises a tab portion positioned beneath the product platform when the product platform is moved from the first position to the second position and is in the second position and the tab portion is configured to lift a free end portion of the product platform as the cover is pivoted to the open position.

In some embodiments, the tab portion is coupled to a panel portion of a side panel of the cover via a curved fold line and, in the second position, the tab portion is angled more toward a front wall than a rear wall of the container portion.

In some embodiments, a first end portion of the product platform is pivotably coupled to a front wall of the product platform and a second end portion of the product platform rests against the tab portion when the product platform is in the second position and, in the second position, the second end portion is raised relative to the first end portion.

In some embodiments, the tab portion is one of a pair of tab portions of the cover positioned beneath the product platform and the pair of tab portions are configured to lift the free end portion of the product platform as the cover is pivoted to the open position.

In some embodiments, the product platform comprises a plurality of support panels that are folded over from a main panel of the product platform and are configured to extend downwardly, toward the base wall, and support the product platform when the product platform is in the first position. The main panel of the product platform is configured to receive the product and configured to extend across an interior cavity defined by the plurality of walls of the container portion when the product platform is in the first position.

In some embodiments, the product platform comprises a central cavity disposed in a main panel of the product platform and a plurality of extension portions that are folded over from the main panel and are positioned around a perimeter of the central cavity. The central cavity is configured to receive the product therein and the plurality of extension portions are configured to support the product within the central cavity.

In some embodiments, a plane defined by the product platform and a base plane, the base plane defined by the base wall of the container portion, form an angle of 30° to 60° when the product platform is in the second position.

In some embodiments, the product platform comprises a first end portion pivotably coupled to a front wall of the container portion and a free, second end portion, the free, second end portion comprising a support panel pivotable about a fold line defined on the product platform, between the support panel and a main panel of the product platform, the support panel being configured to support the free, second end portion of the product platform when the product platform is in the first position.

In some embodiments, the fold line between the main panel and the support panel is configured to maintain the support panel at an angle to the main panel of the product platform, the angle being in a range of 50° to 140°.

In some embodiments, the container portion comprises a front wall extending between two side walls of the container portion. In some embodiments, the front wall includes a central portion arranged between end portions of the front wall that are arranged adjacent to corresponding end portions of the two side walls, the central portion having a first height that is smaller than a second height of the end portions of the front wall. The product platform is pivotably coupled to the central portion of the front wall.

In some embodiments, the container is a one-piece, unitary construction.

In some embodiments, in the second position of the product platform, a rear of the product platform is accessible via spaces between the product platform and side walls of the container portion such that a product received by the product platform can be pushed outward and removed from the product platform.

In another representative embodiment, a container comprises a container portion comprising a plurality of walls defining an interior cavity. The container further comprises a cover pivotably coupled to a rear wall of the container portion, the cover including two side panels arranged on opposite sides of the cover, at least one side panel of the two side panels including a tab portion that is configured to fold over and extend away from a remainder of the at least one side panel. The cover further comprises a product platform configured to receive a product, the product platform being pivotably coupled to a front wall of the container portion at a first end portion of the product platform and configured to pivot between a first position in which the product platform is disposed within the interior cavity of the container portion and a second position in which the product platform is inclined at least partially out of the interior cavity and a second end portion of the product platform, which is disposed opposite the first end portion, is arranged on top of the tab portion of the at least one side panel. The cover is configured to engage the product platform via the tab portion of the at least one side panel such that when the cover is pivoted from a closed position to an open position, motion of the cover pivots the product platform from the first position to the second position such that the product platform is inclined at least partially out of the interior cavity of the container portion at an angle relative to a base wall of the container portion.

In some embodiments, the tab portion is arranged closer to a first end of the cover that is pivotably coupled to the rear wall of the container portion than a second end of the cover that is free and configured to interface with the front wall of the container portion in the closed position.

In some embodiments, in the second position of the product platform, a rear of the product platform is accessible via spaces between the product platform and side walls of the container portion such that a product received by the product platform can be pushed outward and removed from the product platform without causing damage to the container or the product.

In some embodiments, the tab portion is coupled to a remainder of the at least one side panel via a curved fold line and, in the second position, the tab portion is angled more toward the front wall than the rear wall of the container portion.

In some embodiments, the product platform comprises a main panel, a central cavity disposed within the main panel, the central cavity configured to receive the product therein, and a plurality of extension portions that are folded over from the main panel and are positioned around a perimeter of the central cavity. Each extension portion of the plurality of extension portions can include a first end connected to the main panel at a fold line and a free, second end that extends inward, into the interior cavity of the container portion. The free, second ends of the plurality of extension portions are angled toward one another, the plurality of extension portions configured to support the product within the central cavity.

In some embodiments, the product platform comprises a plurality of support panels that are folded over from a main panel of the product platform and are configured to extend downwardly, toward the base wall, and support the product platform when the product platform is in the first position.

In some embodiments, the plurality of support panels includes first and second support panels arranged on opposite sides of the main panel, the opposite sides extending between the first end portion and the second end portion of the product platform, and a third support panel extending across and folded over from the second end portion and pivotable about a fold line defined on the product platform, between the third support panel and the main panel of the product platform. The fold line is configured to maintain the third support panel at an angle relative to the main panel such that the third support panel and the main panel are not arranged in a same plane. The third support panel is arranged above, relative to the base wall, the tab portion of each of the two side panels when the product platform is in the second position.

In another representative embodiment, a container comprises a container portion comprising a plurality of walls defining an interior cavity. The container further comprises a cover pivotably coupled to a rear wall of the container portion, the cover including two side panels arranged on opposite sides of the cover, each side panel of the two side panels including a tab portion that is configured to fold over and extend away from a remainder of the side panel, the tab portion coupled to the remainder of the side panel via a curved fold line. The cover further comprises a product platform configured to receive a product within a central cavity of the product platform, the product platform being pivotably coupled to a front wall of the container portion at a first end portion of the product platform and configured to pivot between a first position in which the product platform is disposed within the interior cavity of the container portion and a second position in which the product platform is inclined at least partially out of the interior cavity of the container portion, and a second end portion of the product platform, which is disposed opposite the first end portion, engages and rests on the tab portion of each of the two side panels. The cover is configured to engage the product platform via the tab portion of each of the two side panels such that when the cover is pivoted from a closed position to an open position, motion of the cover pivots the product platform from the first position to the second position such that the product platform is inclined at least partially out of the interior cavity of the container portion at an angle relative to a base wall of the container portion.

In some embodiments, in the second position, for each of the two side panels, the tab portion is angled more toward the front wall than the rear wall of the container portion.

In some embodiments, the cover is configured to pivot from the closed position to the open position in a first direction, and the cover and the product platform are configured such that motion of the cover in the first direction pivots the product platform in an opposite, second direction from the first position to the second position.

In some embodiments, each side panel of the two side panels of the cover includes a first panel portion and a second panel portion extending from the first panel portion, the second panel portion arranged closer to a fold line between the cover and the rear wall of the container portion than the first panel portion. The tab portion is coupled to the second panel portion via the curved fold line, and the curved fold line curves toward an edge of the second panel portion that is arranged closest to the fold line between the cover and the rear wall, from an outer edge of the second panel portion to an inner edge of the second panel portion that connects to the first panel portion.

The foregoing and other objects, features, and advantages of the disclosed technology will become more apparent from the following detailed description, which proceeds with reference to the accompanying figures.

DETAILED DESCRIPTION

Figure 1:
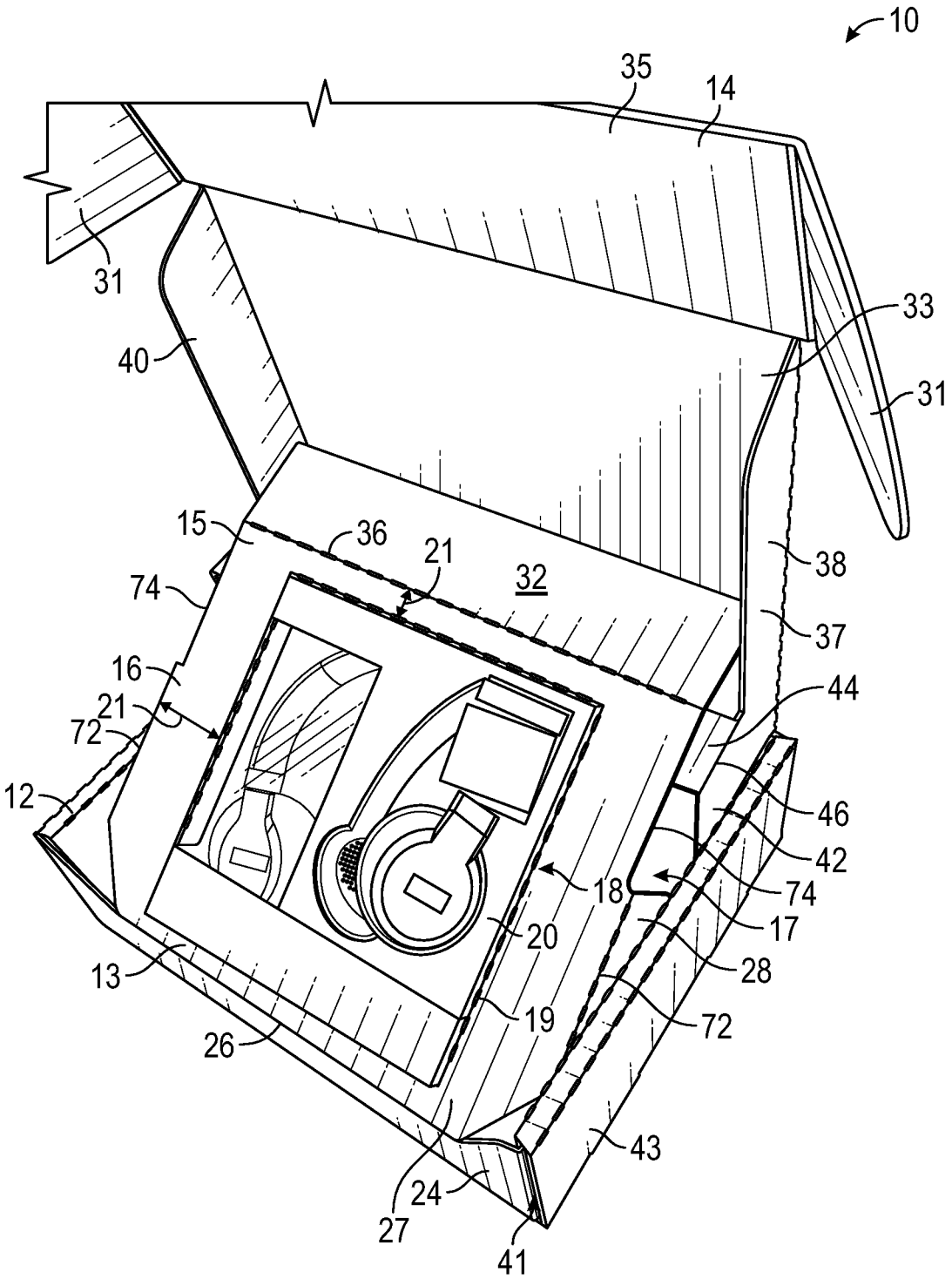
FIG. 1 is a perspective view of an automatic product presenting box, according to one embodiment.

As introduced above, it may be desirable for a container or box, such as a shipping container, to convert from a more compact shipping configuration where a product is packaged and contained within an interior of the container to a display configuration where the product is at least partially lifted out of the interior of the container and is more visible to a user upon opening of the container.

As such, the present disclosure pertains to boxes or containers configured to automatically move or pivot a product contained in the box into a presentation (e.g., display) orientation or position upon opening the box. For example, the container configurations described herein include a container portion and a pivotable cover or lid that operatively engages a pivotable product platform. When the cover is pivoted to the open position, the cover engages the product platform and moves it from a relatively flat, first position (e.g., storage or shipping position) to an angled, second position (e.g., display position) for displaying the product to the user.

FIGS. 1-9 illustrate different views of a representative example of an automatic product presenting container or box 10. The box 10 can comprise a container portion 12 and a cover, top, or lid 14 coupled to the container portion 12 and configured to cover and uncover the container portion 12. The container portion 12 can comprise a pivotable panel configured as a product platform 16. The product platform 16 can be pivotably coupled to a wall (e.g., front wall 24) of the container portion 12 at a first end portion 13, and can have a free, second end portion 15. For example, the second end portion 15 can be unattached to another portion of the container portion 12 and the cover 14. In some embodiments, the first end portion 13 and the second end portion 15 can be first and second end portions of a main panel 27 (also can be referred to as a product-receiving panel) of the product platform 16, as described further below. In some embodiments, the second end portion 15 can include a third support panel 32, as explained further below.

Figure 5:
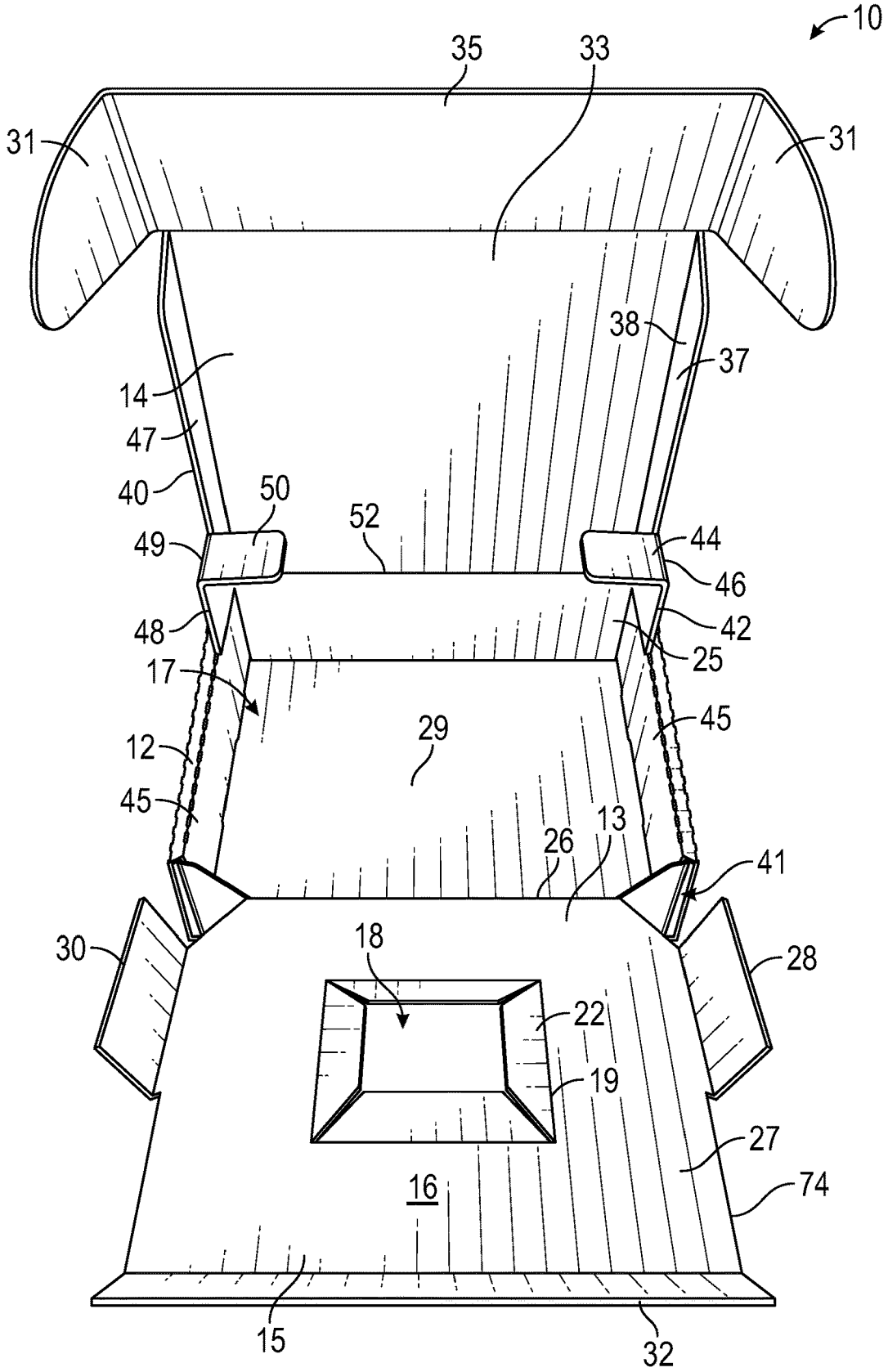
FIG. 5 is a perspective view of the box of FIG. 1 with the product platform folded out of the container portion.
Figure 6:
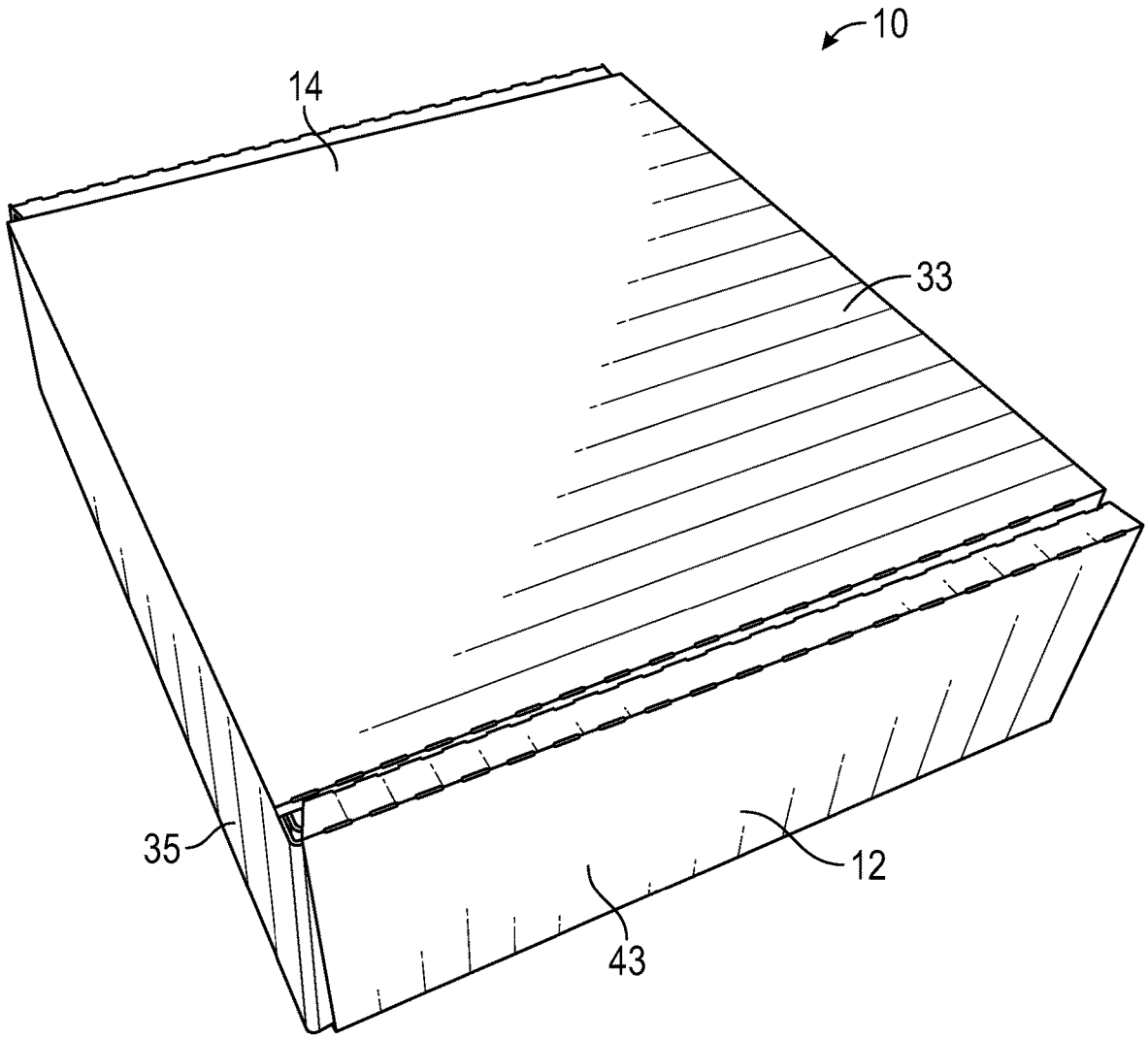
FIGS. 6-8 are perspective views of the box of FIG. 1 illustrating motion of the cover from the closed position to the open position and corresponding motion of the product platform.
Figure 7:
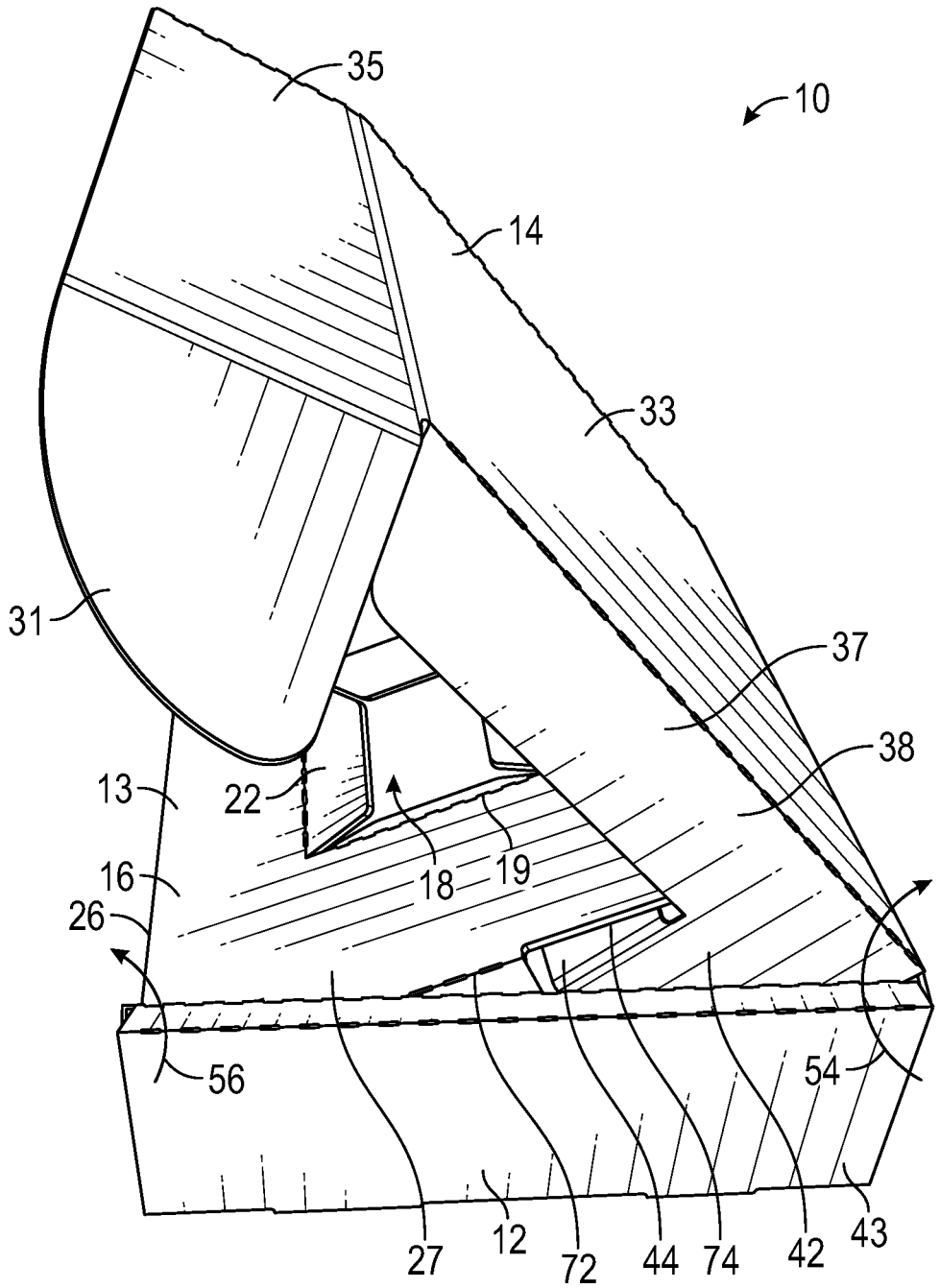
Figure 8:
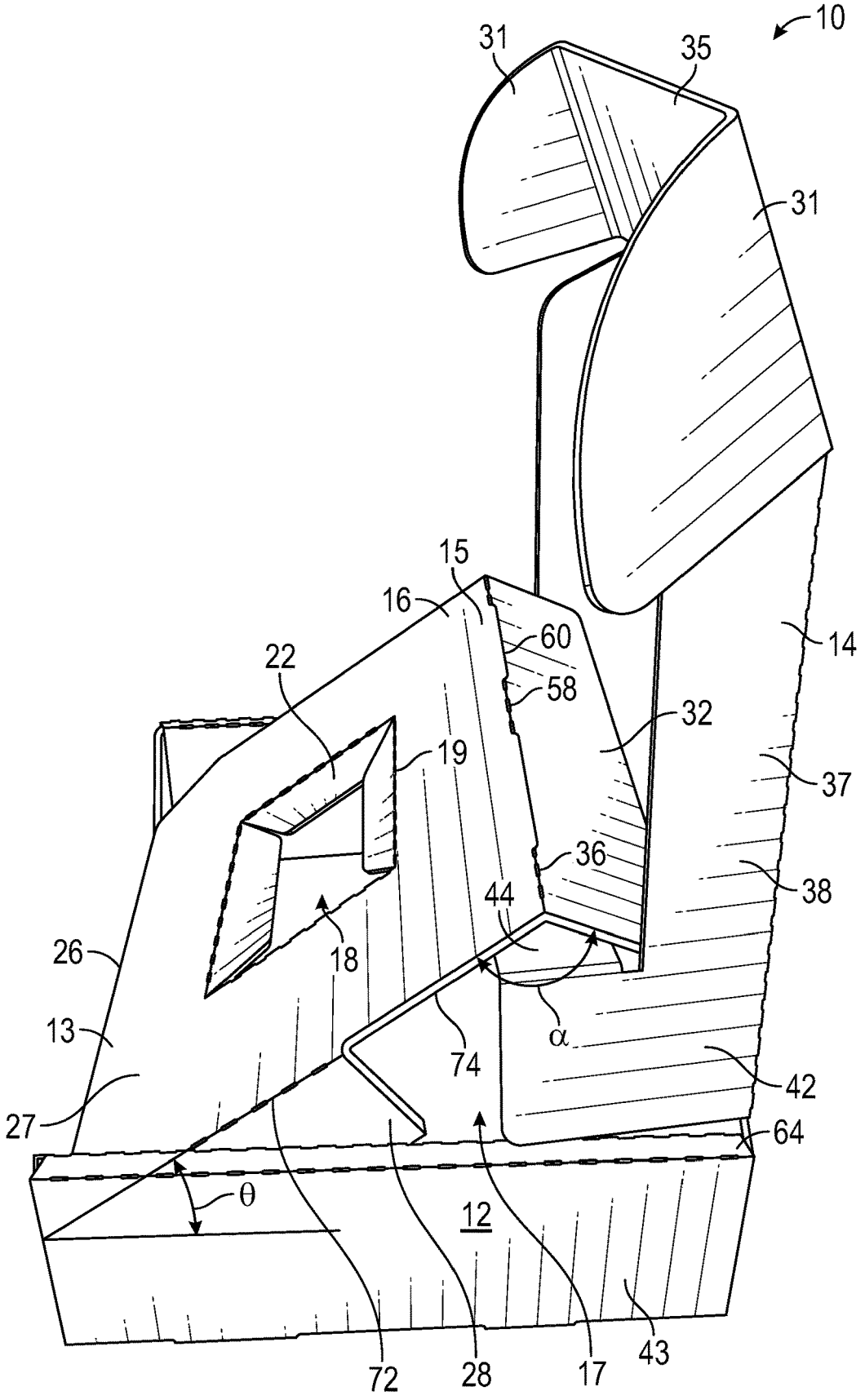

The product platform 16 can be movable or pivotable between a first position in which the product platform 16 is disposed within the container portion 12 (FIGS. 2, 3, and 6) and a second position in which the product platform 16 is inclined relative to the container portion 12 (e.g., relative to a base wall 29 of the container portion 12, as shown in FIG. 5) and extends at least partially out of the container portion 12 at an angle (FIGS. 1, 7, and 8).

Figure 2:
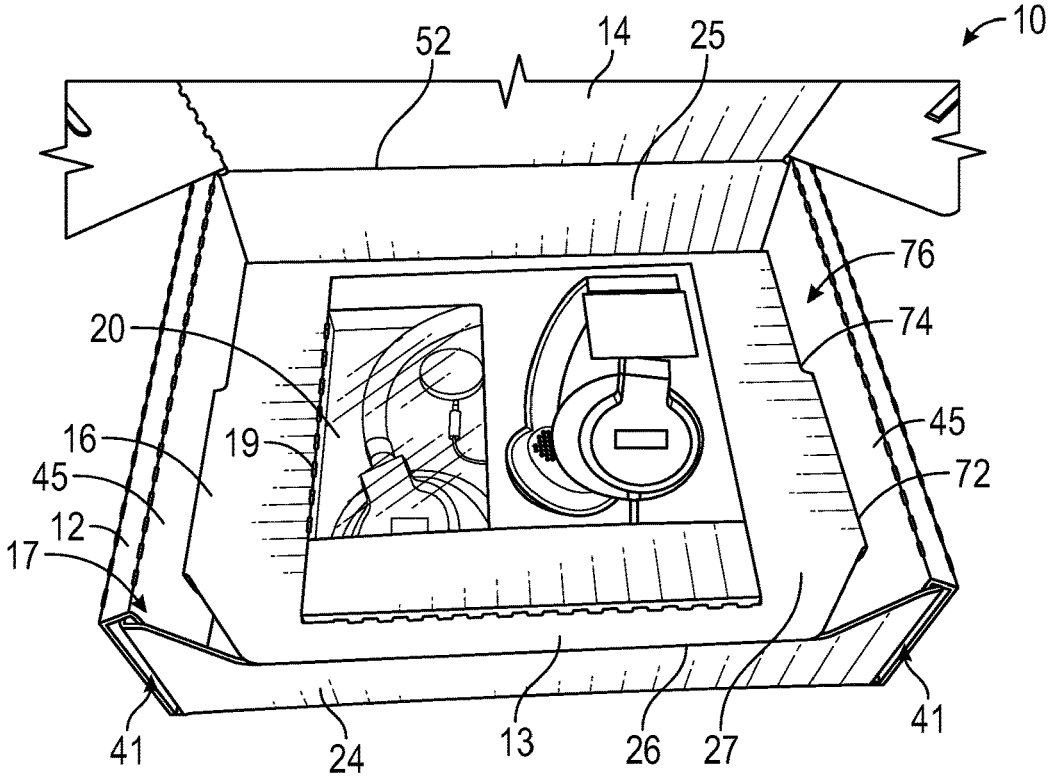
FIGS. 2 and 3 are perspective views of a product platform of the box of FIG. 1 in a first position within the container portion of the box.

In the first position, as shown in FIG. 2, the product platform 16 can extend across an opening or interior cavity 17 of the container portion 12, from the front wall 24 toward an opposite, rear wall 25 where a hinge portion or fold line 52 (FIGS. 2 and 5) of the cover 14 (e.g., between the cover 14 and the rear wall 25) is located. The first position can be referred to herein as a storage or shipping position or configuration. The second position, as described further below, can be referred to herein as a display or presentation position or configuration.

The interior cavity 17 of the container portion 12 can be formed by interior (e.g., inward-facing) surfaces of walls of the container portion 12. For example, as shown in FIG. 5, the interior cavity 17 can be defined by the base wall (which may also be referred to as a floor or bottom wall or panel) 29, an interior surface of the rear wall 25, an interior surface of the front wall 24, and interior surfaces of foldover panels 45 (FIG. 2). Each of the foldover panels 45 can be coupled to a respective side wall 43 of the container portion 12 via one or more fold lines (e.g., cut lines) that are spaced apart from one another, as shown in FIG. 5 (and FIG. 10, as described further below). As explained further below, this configuration of the foldover panels 45 and the side walls 43 may allow for the formation of spaces 41 (FIGS. 2, 4, and 5) that are configured to receive corresponding tab portions 31 of the cover 14 therein.

Figure 4:
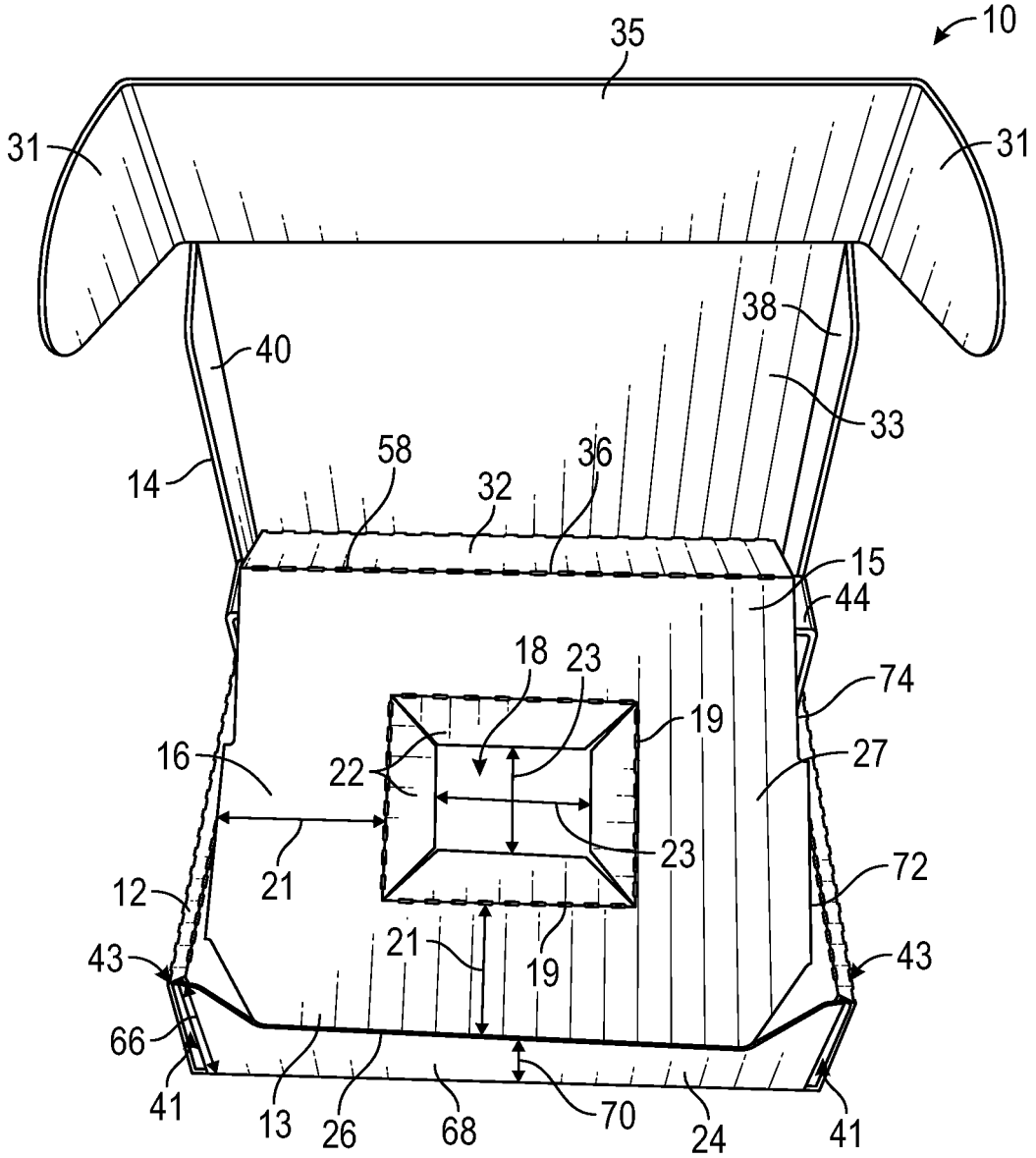
FIG. 4 is a perspective view of the box of FIG. 1 with the cover in the open position and the product platform in the display position.

As shown in FIGS. 4 and 8, the front wall 24 can have end portions that meet with (and/or are arranged adjacent to) respective end portions of the side walls 43. In this way, a height 66 of the end portions of the front wall 24, the height measured in a direction normal to the base wall 29, can be the same or similar to a height of the side walls 43. In some embodiments, as shown in FIGS. 4 and 8 (and also in the embodiment of FIG. 13, as described further below), a central portion 68 of the front wall 24, arranged between the end portions of the front wall 24, has a height 70 that is smaller (e.g., shorter) than the height 66. In some embodiments, the product platform 16 is coupled to the front wall 24, along the central portion having the height 70.

In certain embodiments, the product platform 16 can be coupled to the front wall 24 of the container portion 12 by a flexible connection such as a living hinge or fold line 26 formed between the front wall 24 and the product platform 16.

Figure 3:
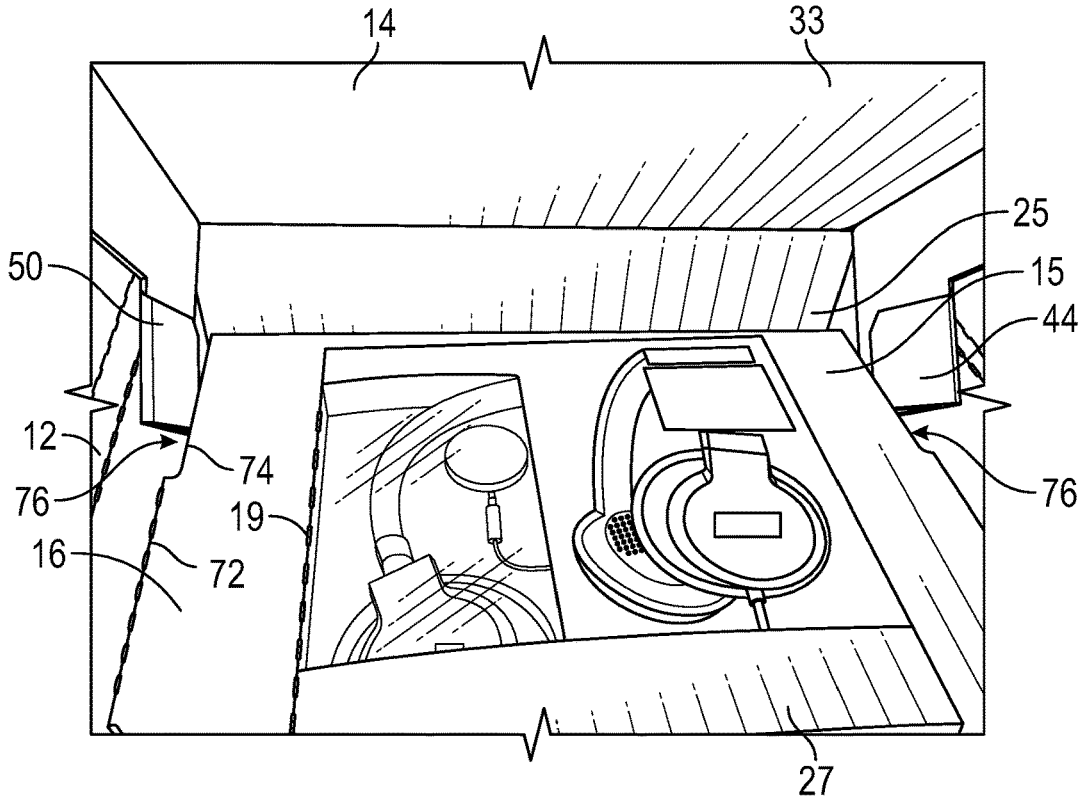

The product platform 16 can comprise a central opening or cavity 18 configured to receive a product 20. FIGS. 1-3 illustrate a product 20 situated in the central cavity (also referred to herein as the cavity) 18, and FIGS. 4, 5, and 7-9 illustrate the product platform 16 without a product in the cavity 18. The dimensions of the cavity 18 can be configured according to the particular product to be received.

Referring to FIG. 4, the product platform 16 can comprise a plurality of flaps, tabs, or extension portions 22 positioned around the perimeter of the cavity 18. Each of the extension portions 22 can be coupled, at a first end of each extension portion 22, to a main panel 27 of the product platform 16 by a corresponding flexible connection, such as a fold line 19. In some embodiments, the fold line 19 may be a cut line formed by a plurality of cuts or perforations that extend at least partially through the panel in order to facilitate folding or hinging along the fold line 19. The main panel 27 can be the portion of the product platform that is pivotably coupled to the container portion 12 via the fold line 26.

A second end of each extension portion 22 may be a free end, and the free ends of each of the extension portions 22 can extend or angle toward one another (e.g., instead of direction down toward the base wall 29 when the product platform is in the first position). As a result, the cavity 18 may narrow slightly from the main panel 27 to the free ends of the extension portions 22. In this way, the extension portions 22 can be configured to support the product 20 within the cavity 18.

For example, in some embodiments, the distances 23 between oppositely arranged extension portions 22, across the cavity 18, can be smaller than corresponding dimensions of the product to be received therein such that the extension portions engage and frictionally retain the product in the cavity (FIG. 4).

Distances 21 between each fold line 19 of each extension portion 22 and opposite edges of the main panel 27 (FIGS. 1 and 4) can be configured (e.g., sized) based on the desired product to be received within the cavity 18. For example, in some embodiments, the cavity 18 can be larger, in order to accommodate a larger product 20, thereby resulting in smaller distances 21 (FIG. 1) as compared to a smaller cavity 18 that can accommodate a smaller product, thereby resulting in larger distances 21 (FIG. 4).

In the illustrated embodiments, the cavity 18 is rectangular. However, the cavity 18 can have any of a variety of shapes to accommodate a variety of products. For example, the cavity 18 can be round, oval, square, polygonal, or combinations thereof. The cavity 18 can also have a stepped depth/width. In this way, the cavity 18 can be shaped and sized to receive and hold a desired product therein.

The product platform 16 can comprise a plurality of extension portions, support panels, or legs configured to extend downwardly, toward the base wall 29 (which forms a base, bottom, and/or floor of the container portion 12), and contact the base wall 29 of the container portion 12 (e.g., when the product platform 16 is in the first position, as shown in FIG. 2). For example, with reference to FIGS. 1 and 5, the product platform 16 can comprise first and second support panels 28 and 30 that are coupled to and folded over from side edges of the main panel 27 of the product platform 16, and a third support panel 32 (e.g., a free end portion of the product platform) that is coupled to and folded over from the main panel 27. For example, in the first and second positions of the box 10, when the product platform 16 is at least partially arranged within the interior cavity 17 of the box 10, the first and second support panels 28 and 30 can extend downwardly from the side edges of the main panel 27 of the product platform 16.

In the first position of the product platform 16 (FIGS. 2 and 3), the third support panel 32 can extend downwardly and contact the base wall 29, and thus, it may also be in contact with (e.g., in some embodiments, in face-sharing contact with), the rear wall 25 of the container portion 12. For example, in the first position, a free end of the third support panel 32 (e.g., opposite the end coupled to the main panel 27 via the fold line 36), can contact the base wall 29 of the container portion 12. In the second position of the product platform (FIGS. 1, 4, and 8), the third support panel 32 can extend outwardly from the main panel 27 and toward a main panel (also referred to as a top panel) 33 of the cover 14.

Each of the first support panel 28, second support panel 30, and third support panel 32 can be joined to the main panel 27 of the product platform 16 at a fold line or cut line. For example, the third support panel 32 can be joined to the product panel at a hinge or fold line 36 (FIG. 4).

Figure 9:
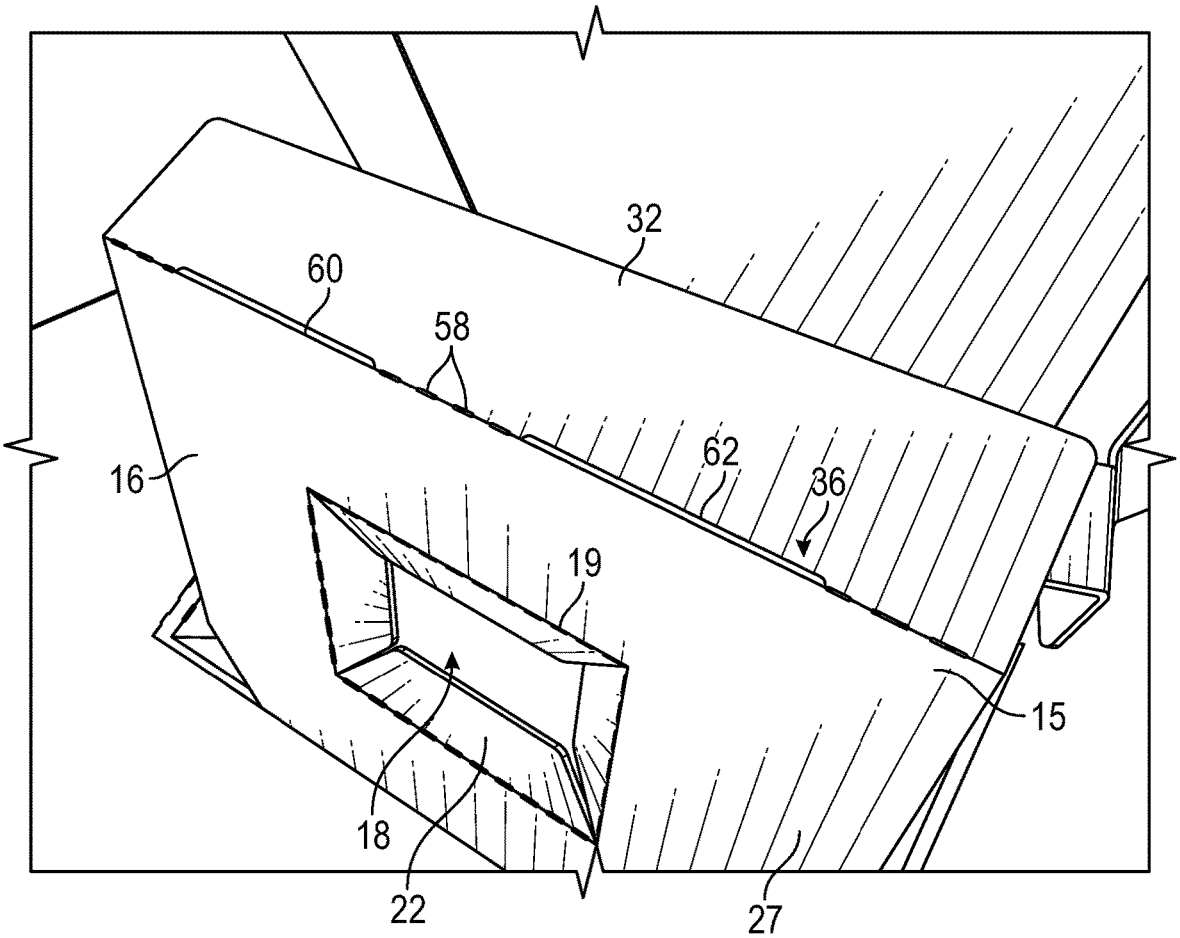
FIG. 9 is a perspective view of a free end portion of the product platform.

With reference to FIGS. 8 and 9, in certain embodiments, the fold line 36 can comprise a plurality of relatively short cuts or score lines 58, and one or more relatively longer cuts or slits 60 with extension portions or overhangs 62 extending from the main panel 27 of the product platform 16 toward the cover 14. The extension portions 62 can be configured to add rigidity to and resist counterclockwise rotation of the third support panel 32 after it is folded down such that the third support panel 32 remains at an angle $\alpha$ (FIG. 8) with the product platform 16 of from 50° to 140° or from 90° to 140° when free from the cover 14. Once the third support panel 32 is inserted into the container portion 12 and the cover 14 is closed, the angle $\alpha$ can be from 60° to 90° or 70° to 90°. This can help to keep the third support panel 32 from binding, thereby allowing the cover 14 to be repeatedly opened and closed. In this way, the fold line 36 can be configured to maintain the third support panel 32 at an angle (e.g., angle $\alpha$, which can be from 50° to 140°) relative to the main panel 27, such that the third support panel 32 and the main panel 27 are not arranged in a same plane (e.g., are non-parallel). In certain embodiments, this can facilitate easier reclosure of the box by reducing or eliminating the tendency of the free edge of the third support panel 32 to bind on the rear wall or the main panel 33 of the cover 14 during closing.

In other embodiments, the fold line 36 can include a series of score lines or perforations (e.g., may be configured as a cut line) without extension portions, such as shown in FIG. 1.

Referring again to FIG. 1, the cover 14 can comprise first and second side portions or panels 38 and 40 configured to extend into the container portion 12 when the cover 14 is closed (as shown in FIG. 6). The first side panel 38 can comprise a first panel portion 37 and a second panel portion (e.g., extension panel portion) 42 extending from the first panel portion 37 of the first side panel 38. A tab portion (which can also be referred to as an extension portion or tab or lifting tab) 44 can be coupled to the second panel portion 42 at a fold line 46, and can extend from the second panel portion 42 at an angle and in a direction toward the second side panel 40. The second side panel 40 can be configured similarly, with a first panel portion 47, a second (e.g., extension) panel portion 48, and a tab portion 50 extending from the second panel portion 48 in a direction toward the first side panel 38 (FIG. 5).

In some embodiments, the cover 14 can include one or more of the tab portions 44 and/or 48. For example, in some embodiments, the cover 14 can include the tab portion 44 but not the tab portion 48 or the tab portion 48 but not the tab portion 44. In this way, in some embodiments, at least one of the side panels 38 and 40 of the cover 14 can include a tab portion. The cover 14 can also include multiple tab portions on each side, such as two tab portions, three tab portions, etc., spaced apart along the length of the flaps 38 and 40.

The tab portions 44 and 50 can each have a length that is configured to allow them to extend a portion of a distance between the corresponding second panel portion 42 or 48 and a center of the box. For example, in some embodiments, the length of each tab portion 44 and 50, the length measured between their free end and an end attached to the corresponding second panel portion 42 or 48 (e.g., at their fold lines), can be selected to be short enough to maintain a substantially parallel orientation relative to the base wall 29 (e.g., as shown in FIG. 5) and long enough to extend underneath the product platform 16, thereby enabling the tab portions 44 and 650 to hold the second end portion 15 of the product platform 16 in its elevated position (as shown in FIG. 1), while a product is arranged within the cavity 18.

The tab portions 44 and 50 can be configured to fold over from and be positioned against the corresponding second panel portions 42 and 48 of the corresponding first and second side panels 38 and 40 (FIG. 3). As such, when the product platform is arranged within the interior cavity 17 (e.g., in the first position) and/or when the cover 14 is closed (FIG. 6), the tab portions 44 and 50 are in their folded over configuration and arranged between the corresponding side panel 38 and 40 and the product platform 16.

The main panel 27 of the product platform 16 can include oppositely arranged (e.g., across the main panel 27) sides (e.g., side edges) 72 that each extend between the first end portion 13 and the second end portion 15 of the product platform 16. In some embodiments, each of the sides 72 can include an indented/recessed portion (e.g., indented edge portion) 74 that is indented inward, toward the central cavity 18, relative to a remainder of a corresponding side 72 of the two sides 72 of the main panel 27. The indented portion 74 of each of the two sides 72 can be arranged at the second end portion 15 of the product platform 16 (FIGS. 1-4). The indented portion 74 of each side 72 of the main panel 27 forms a space 76 between a corresponding interior side wall (e.g., inner surface of foldover panel 45 in the embodiment of FIGS. 1-9) of the container portion 12 and the corresponding side 72 of the main panel 27 (FIGS. 2 and 3). As shown in FIG. 3, each space 76 is configured (e.g., shaped) to receive a corresponding tab portion 44 or 50, during setup of the box, in order to position the tab portions 44 and 50 beneath the product platform 16.

After positioning the tab portions 44 and 50 underneath the product platform 16 (FIG. 3), each of the tab portions 44 and 50 are configured to unfold and extend toward an opposite one of the tab portions 44 and 50 (FIGS. 1, 5, and 7). For example, in some embodiments, each of the tab portions 44 and 50 are configured to unfold and be arranged substantially parallel with the base wall 29 upon moving the cover 14 into the open position. For example, in some embodiments, upon moving the cover 14 into the open position, each of the tab portions 44 and 50 are configured to be arranged at an angle in a range of about 75° to about 100° or about 85° to about 95°, the angle measured between the tab portion 44 or 50 and the corresponding second panel portion 42 or 48.

The cover 14 can further comprise a front panel 35 coupled to the main panel 33 via a fold line and two tab portions 31 arranged on opposite sides of and coupled the front panel 35 via respective fold lines (FIGS. 1 and 4-8). The tab portions 31 can be configured to interface with and insert into spaces 41 (see FIGS. 2, 4, and 5) formed between the front wall 24 and a respective side wall of two oppositely arranged side walls 43 of the container portion 12. For example, in the closed configuration of the box 10 shown in FIG. 6, the tab portions 31 are arranged/received within their respective spaces 41 and the front panel 35 of the cover 14 overlays (e.g., covers) the front wall 24 of the container portion 12.

In use, a product (e.g., product 20 shown in FIGS. 1-3) can be inserted into the cavity (e.g., product cavity) 18, and the support panels 28, 30, and 32 can be folded downwardly, toward the base wall 29. The tab portions 44 and 50 of the cover 14 can be folded into the position shown in FIG. 5 such that they are angled toward one another and extend over top of the interior cavity 17 of the container portion 12.

The product platform 16 can be situated on top of the tab portions 44 and 50, as shown in FIGS. 1, 4, 7, and 8. The third support panel 32 can be folded around or over the tab portions 44 and 50 such that the tab portions 44 and 50 are positioned beneath the product platform 16, relative to the base wall 29. For example, in the configuration shown in FIGS. 1, 4, 7, and 8, an inner (e.g., inward-facing) surface of the second end portion 15 of the product platform 16 (and/or the main panel 27) can contact and/or rest against (e.g., be arranged on top of) outer (e.g., outward-facing) surfaces of the tab portions 44 and 50. In some embodiments, an inner surface of the third support panel 32 can also engage and/or rest against the outer surfaces of the tab portions 44 and 50.

The cover 14 can then be moved to the closed position shown in FIG. 6, and the product platform 16 can be enclosed within the container portion 12 of the box 10. In this closed position, the support panels 28, 30, and/or 32 can contact the inner surface of the base wall 29 of the container portion 12 to provide support for the product platform 16 and the product inserted into the cavity 18 during shipment.

For example, when moving the box 10 from the open position (FIGS. 1, 4, and 8) to the closed position (FIG. 6), the second panel portion 42 of the first side panel 38 and the second panel portion 48 of the second side panel 40 can slide into the interior cavity 17 and along or adjacent to the inner surfaces of the foldover panels 45 (or side walls 43 if the box 10 does not include foldover panels 45), toward the base wall 29. As the second panel portions 42 and 48 and the corresponding tab portions 44 and 50 slide inward and downward, as the cover 14 is moved toward the closed position, the product platform 16 is lowered into the interior cavity 17 (FIG. 7).

With reference to FIG. 7, when the box 10 is opened by a user, the cover 14 can be opened or pivoted upwardly about the fold line 52 (FIG. 5) in a first direction indicated by arrow 54 toward the open position (as shown in FIG. 8). The tab portions 44 and 50 can engage the product platform 16 (e.g., engage an inner surface of the main panel 27 of the product platform 16), and can lift the free, second end portion 15 such that the product platform 16 pivots about the fold line 26 in a second direction indicated by arrow 56. The first and second directions shown in FIG. 7 can be opposite directions, relative to one another. The product platform 16, and the product received in the cavity 18, are thereby lifted, pivoted, rotated, and/or inclined at least partially out of the interior cavity 17 of the container portion 12 into a second, presentation position or orientation where the product faces the user.

FIG. 8 shows the cover 14 in the fully open position and the product platform 16 in the presentation position (e.g., the second position referred to above). When the product platform 16 is in the second or presentation position, a plane defined by the main panel 27 of the product platform 16 can form an angle θ with a plane defined by the base wall 29 of the container portion 12 (e.g., a base plane defined by the base or base wall 29 of the container portion). In certain embodiments, the angle θ can be 30° or greater, such as from 30° to 90°, 30° to 60°, 40° to 60°, or 45° to 50°.

In some embodiments, as shown in FIG. 8, when the box 10 is in the fully open position, the second end portion 15 of the product platform 16 is raised by and rests against the tab portions 44 and 50. Further, in this position, an edge portion of the first end portion 13 of the product platform 16 that is directly coupled to the front wall 24 can remain in a same position, that is not raised relative to the second end portion 15, since it is coupled to the container portion 12.

In some embodiments, in the fully open position, as shown in FIG. 8, an edge of each of the second panel portions 42 and 48 of the cover 14 can contact and/or rest on a respective top surface 64 formed between the fold lines separating the respective side wall 43 and foldover panel 45. In this way, the product platform 16 can be maintained (e.g., held) in the elevated, presentation position (e.g., in a retail display).

In some embodiments, once the cover 14 is open, the product can be removed from the product platform 16 by reaching behind the product platform 16 and pushing the product outwardly from the cavity 18. For example, as shown in FIG. 8, in the second position of the product platform 16 (when the cover 14 is open), the interior cavity 17 of the container portion 12 is exposed and a rear of the product platform 16 is accessible via spaces between the product platform 16, the cover, and side walls 43 of the container portion 12 such that the product can be directly touched from behind and pushed outward and removed from the product platform 16. For example, the product can be pushed outward and removed from the product platform 16 without damage (e.g., tearing) to the box or the product.

Figure 10:
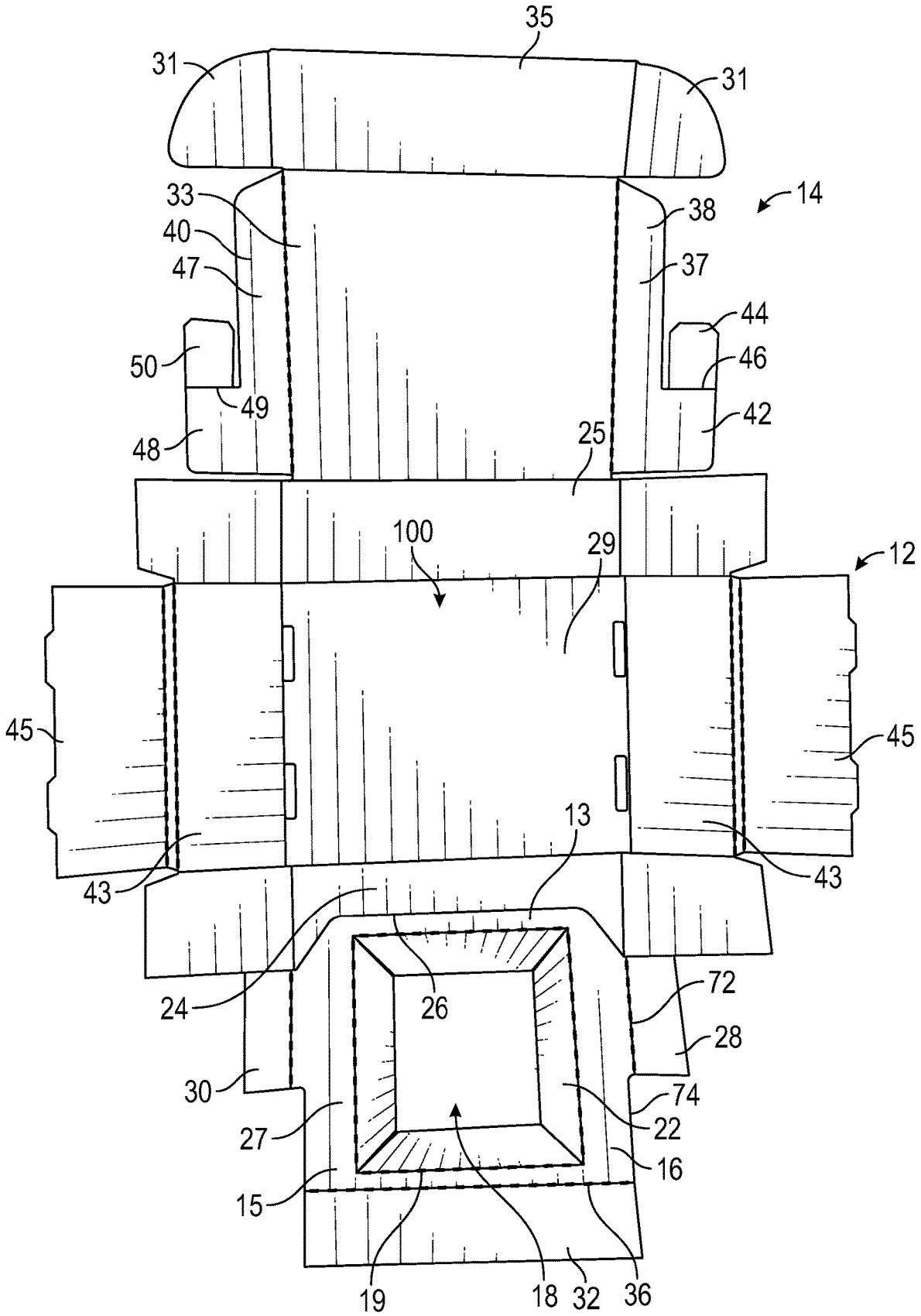
FIG. 10 is a top plan view of a representative embodiment of a blank from which the box of FIG. 1 can be constructed.

In certain embodiments, the box 10 can be constructed, folded, or assembled from a single piece of material, such as corrugated paperboard having one or more face sheets with a corrugated or fluted layer therebetween. FIG. 10 shows a representative example of a corrugated paperboard blank 100 from which the box 10 can be assembled. The blank 100 can comprise a one-piece, unitary construction wherein each of the walls, extension portions, tabs, fold lines, etc., are integrally formed with the blank. As used herein, the terms "unitary construction" and "integrally formed" refer to a construction that does not include any welds, fasteners, or other means for securing separately formed pieces of material to each other. In other embodiments, any of the various panels, extension portions, tabs, etc., can be separately formed and secured to the main body of the box. The box configurations described herein can also be made from polymeric materials. In certain embodiments, each of the cuts, fold lines, score lines, etc., of the blank 100 can be formed in an in-line, streamlined manufacturing process such that the blank can be produced without requiring that the production equipment be stopped.

Different embodiments of the boxes described herein can provide one or more significant advantages over existing boxes. For example, certain embodiments of the boxes or containers described herein can securely receive a product and protect the product during shipment while minimizing the package's dimensions or form factor. The "built-in" product platform provides corner and edge protection for the product during shipping. Upon opening the box, the pivoting motion of the cover can pivot the product up to a preselected viewing angle at which it can be easily seen by the recipient, heightening the "unboxing experience." Some embodiments of the disclosed containers can also be used for retail displays to display the product on a flat surface such as a counter without the need for angled stands, and without the need to remove the product from the box. Another advantage of certain container embodiments described herein is that due to the ability to access the product from behind (e.g., by reaching within the container portion behind the product platform), the product can be easily removed from the product platform (e.g., when in the second position) by pushing the product forward out of the cavity from the rear or under side of the product. Additionally, by restricting rotation or folding of the third support panel 32, the score lines, cuts, and extension portions of the fold line 36 can help to keep the third support panel 32 from binding, thereby allowing the cover 14 to be repeatedly opened and closed.

In other embodiments, the cover 14 and the product platform 16 can be operatively coupled together by any of a variety of coupling or engaging means configured such that as the cover 14 is moved to the open position, the product platform is rotated, pivoted, or lifted to the display orientation. For example, in certain embodiments the cover 14 can comprise extension members or hook members configured to be received in and move along corresponding slots defined in the product platform 16 or vice versa. In certain embodiments, the cover 14 and the product platform 16 can be operatively coupled together by a plurality of filaments or strands, such as elastic bands, strings, threads, yarns, etc. In certain embodiments, the cover 14 and the product platform 16 can be operatively coupled together by hook-and-loop fasteners.

Figure 11:
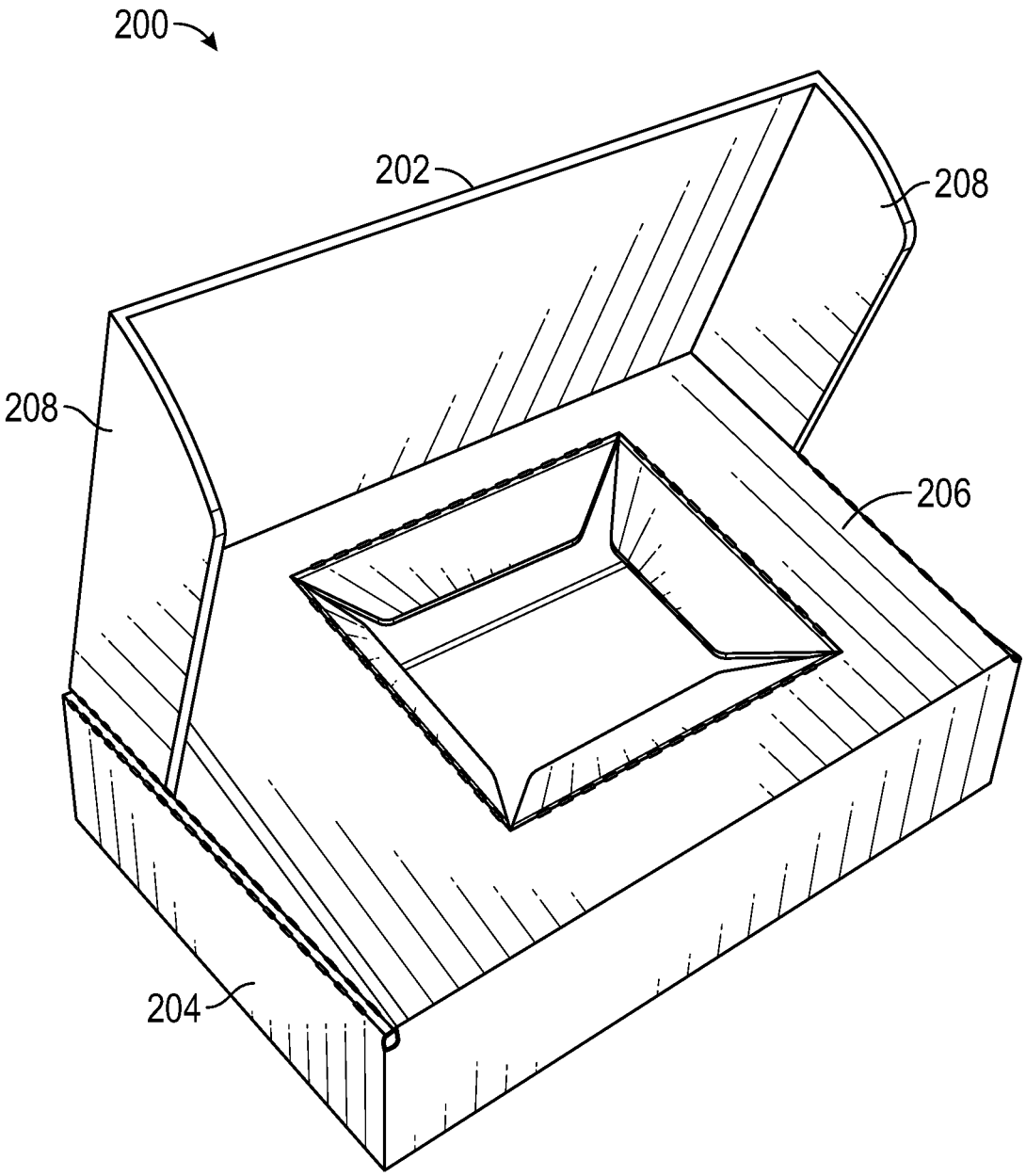
FIG. 11 is a perspective view of another embodiment of an automatic product presenting box.
Figure 12:
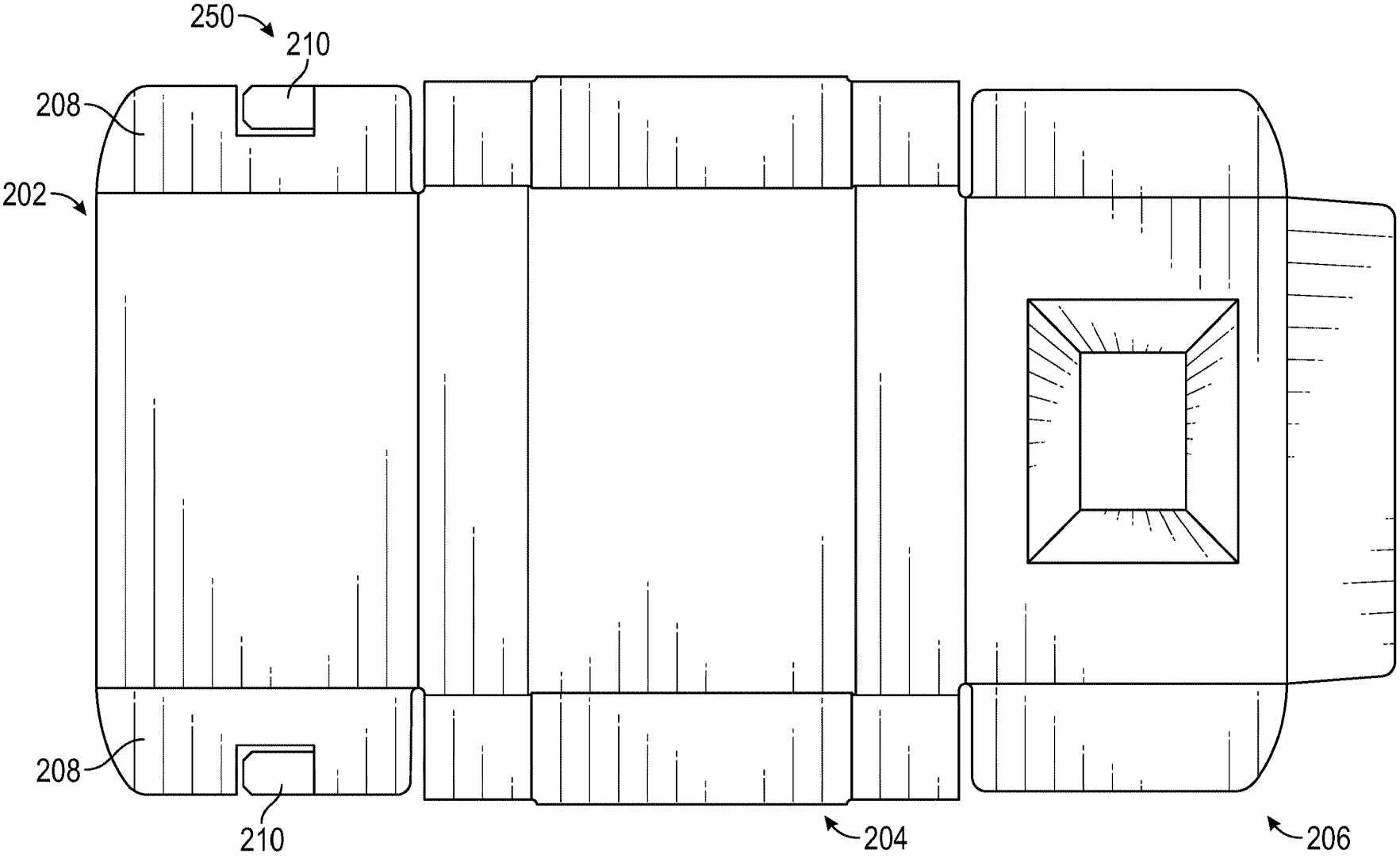
FIG. 12 is a top plan view of a representative embodiment of a blank from which the box of FIG. 11 can be constructed.

The pivoting product platform and cover member system described herein can also be adapted for use in other styles of boxes or containers. FIGS. 11 and 12 illustrate another embodiment of a container or box 200 including a pivotable cover 202 and a container portion 204 into which a pivotable product platform 206 can be incorporated. FIG. 11 illustrates a perspective view of the box 200 and FIG. 12 illustrates a plan view of a blank 250 from which the box 200 can be constructed. Box 200 may be similar to the box 10 of FIGS. 1-10.

The product platform 206 can be operatively coupled to the cover 202 by any of the mechanisms described herein such that pivoting or opening motion of the cover can lift or pivot the product platform 206 into a second or display position. For example, in certain embodiments the cover 202 can include side panels 208 that include integrated lifting tab portions 210 (FIG. 12) configured to engage the product platform 206 and rotate it upwardly as the cover 202 is opened. The lifting tab portions 210 may be similar in function to the tab portions 44 and 50 of the first and second side panels 38 and 40 of the box 10 of FIGS. 1-10, as described above.

In some embodiments, the side panels 208 can be shaped the same or similarly to the first and second side panels 38 and 40 of box 10 of FIGS. 1-10. Further, in these embodiments, the tab portions 210 can be shaped as shown in FIG. 12 or may be shaped similarly to the tab portions of box 300, as shown in FIG. 20 (as described further below).

Figure 20:
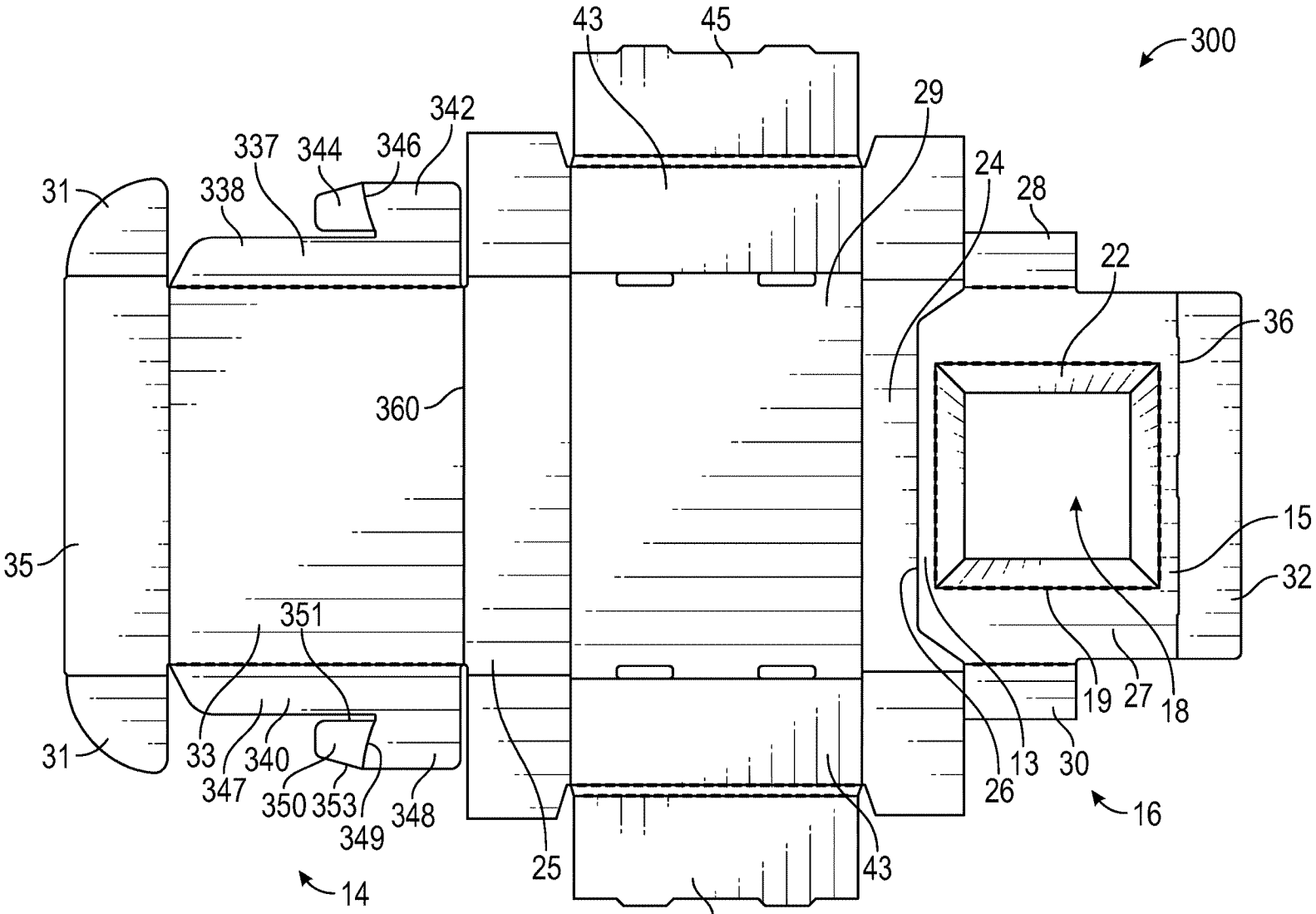
FIG. 20 is a top plan view of a representative embodiment of a blank from which the box of FIG. 13 can be constructed.

Turning now to FIGS. 13-20, another embodiment of an automatic product presenting container or box 300 which can be configured to convert from a more compact shipping configuration where a product is packaged and contained within an interior of the box 300 to a display configuration where the product is at least partially lifted out of the interior of the box 300 and is more visible to a user upon opening of the box is shown. FIGS. 13-19 show various views of the box 300 in an assembled configuration. FIG. 20 shows the box 300 in a "blank" or flat configuration.

In certain embodiments, the box 300 can be similar to the box 10 of FIGS. 1-10. Thus, components of the box 300 that are the same or similar to the components of the box 10 are labeled the same in FIGS. 13-20 and are not described again below for the sake of brevity.

Figure 13:
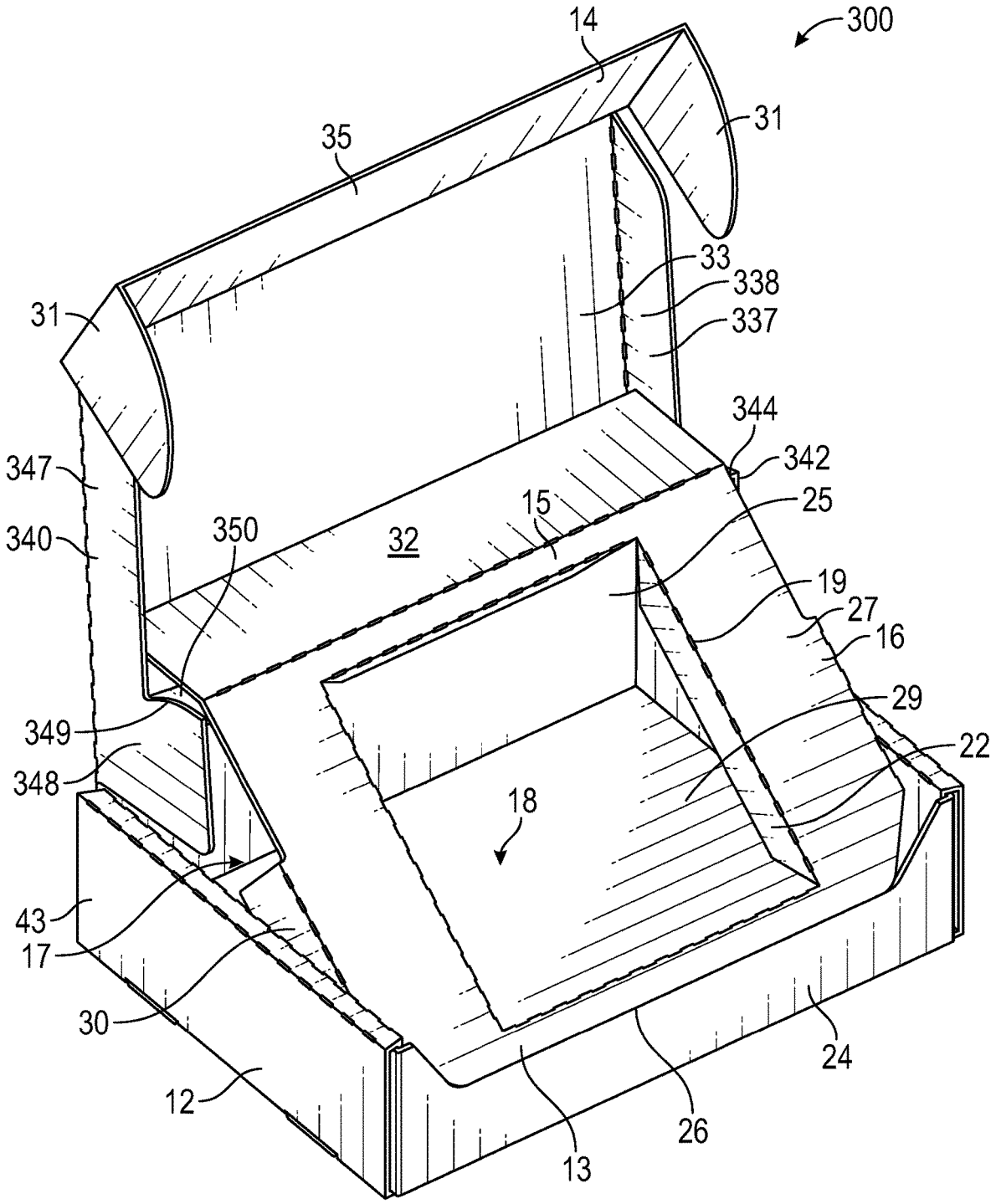
FIG. 13 is a perspective view of another embodiment of an automatic product presenting box.
Figure 14:
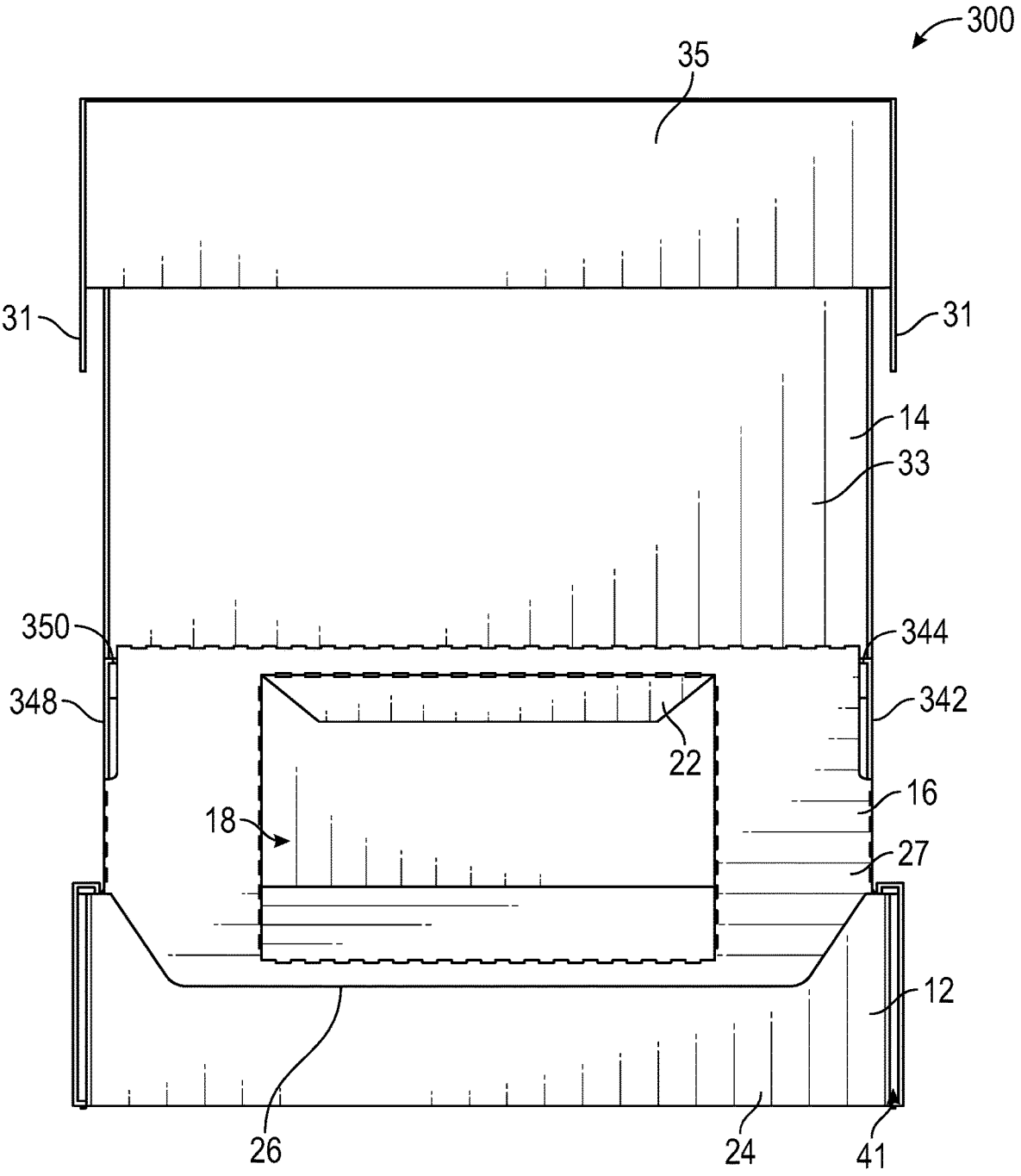
FIG. 14 is a front view of the box of FIG. 13.
Figure 15:
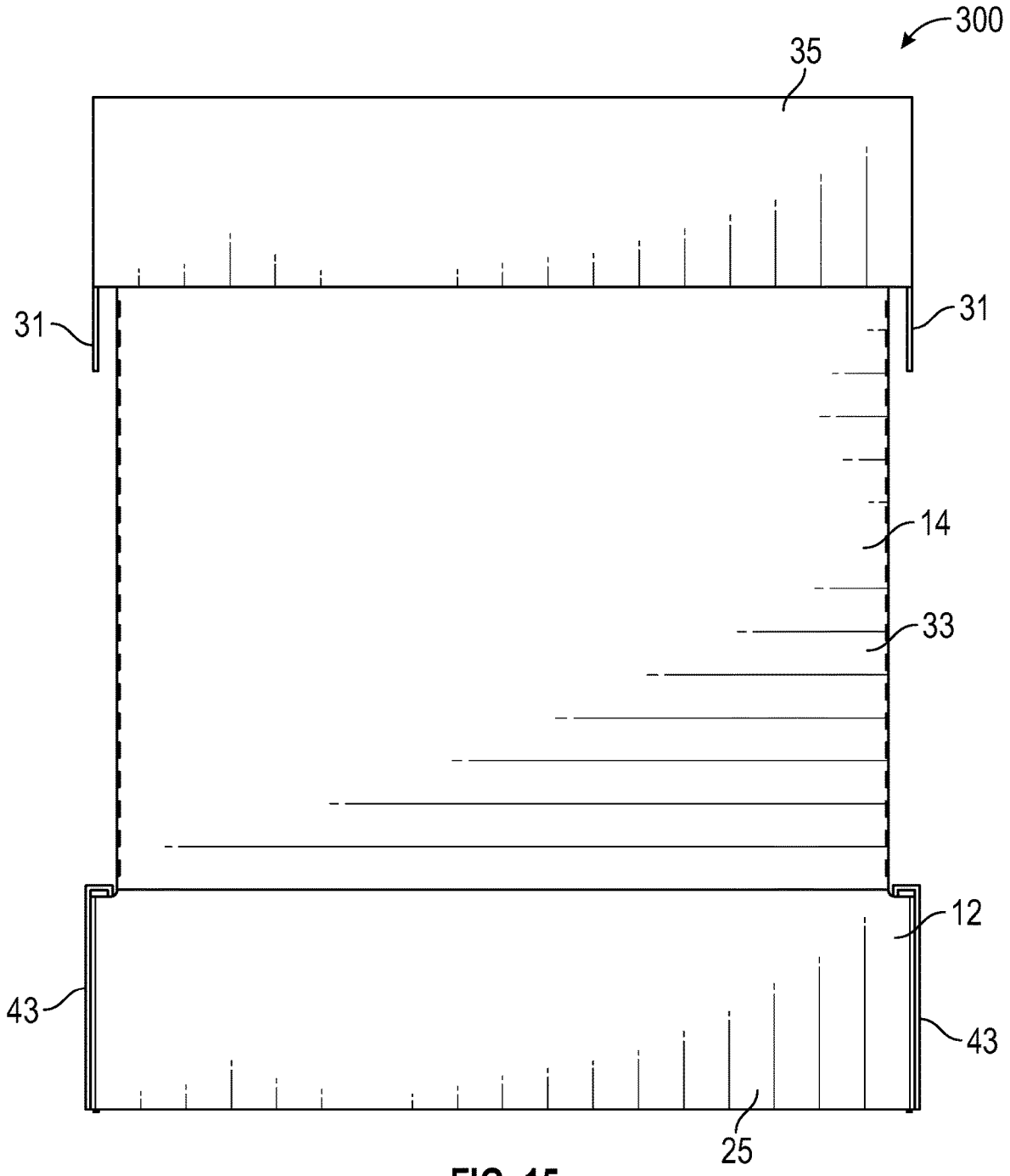
FIG. 15 is a rear view of the box of FIG. 13.
Figure 16:
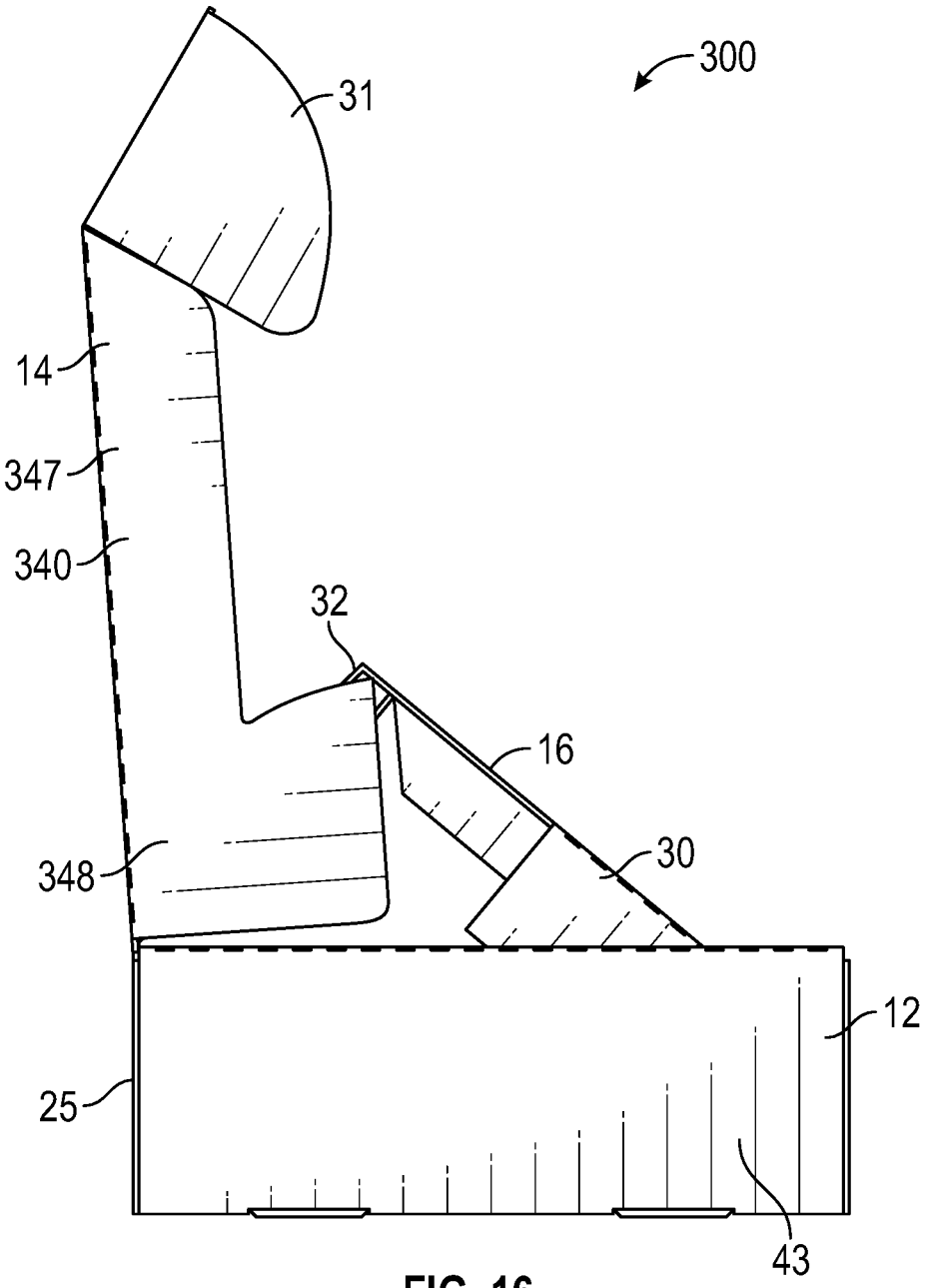
FIG. 16 is a left side view of the box of FIG. 13.
Figure 17:
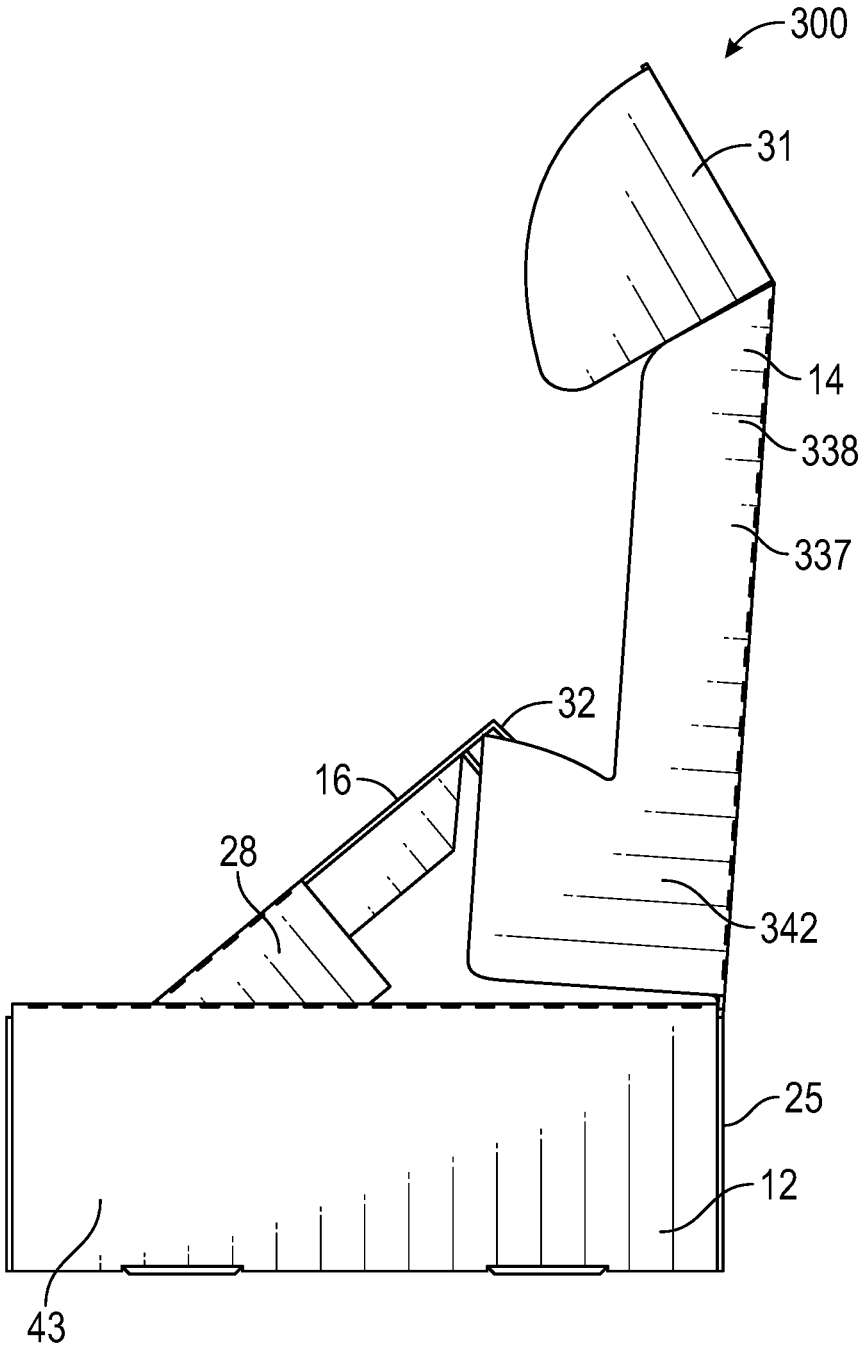
FIG. 17 is a right side view of the box of FIG. 13.
Figure 18:
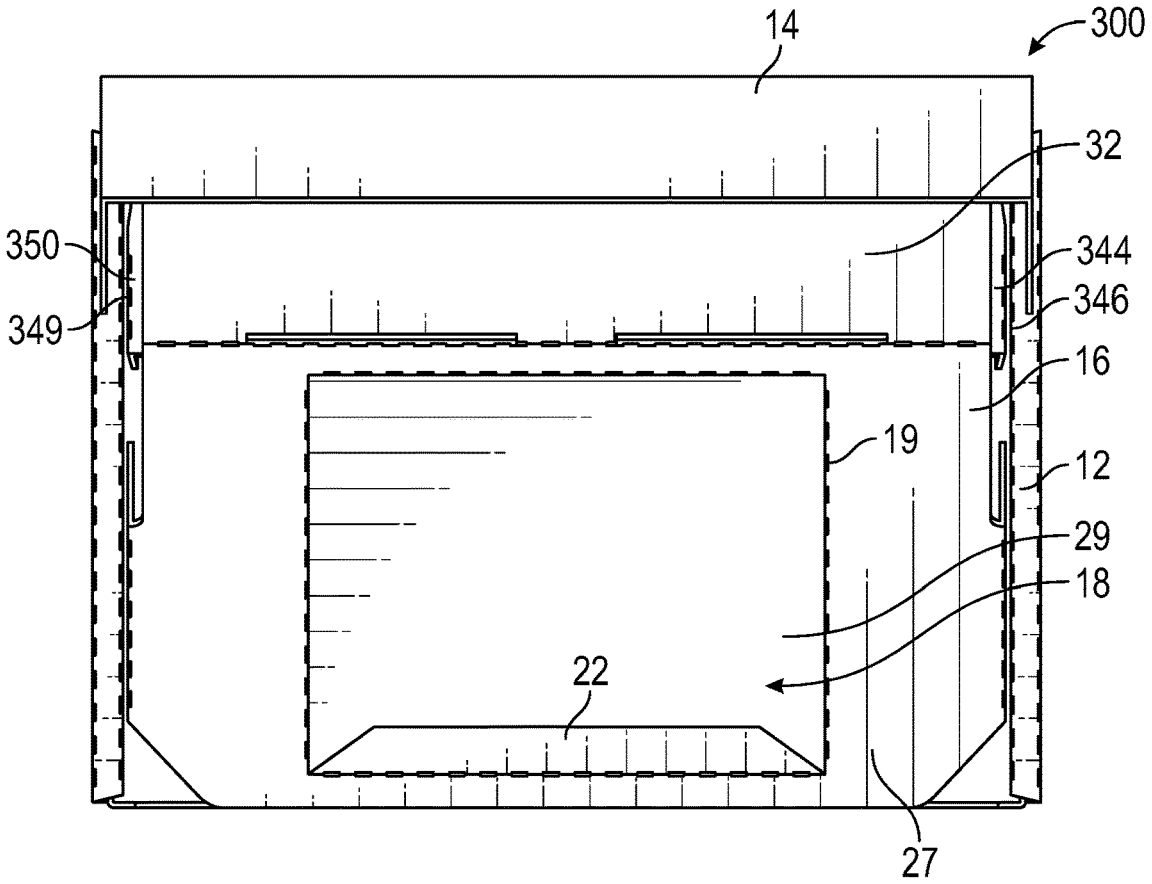
FIG. 18 is a top plan view of the box of FIG. 13.
Figure 19:
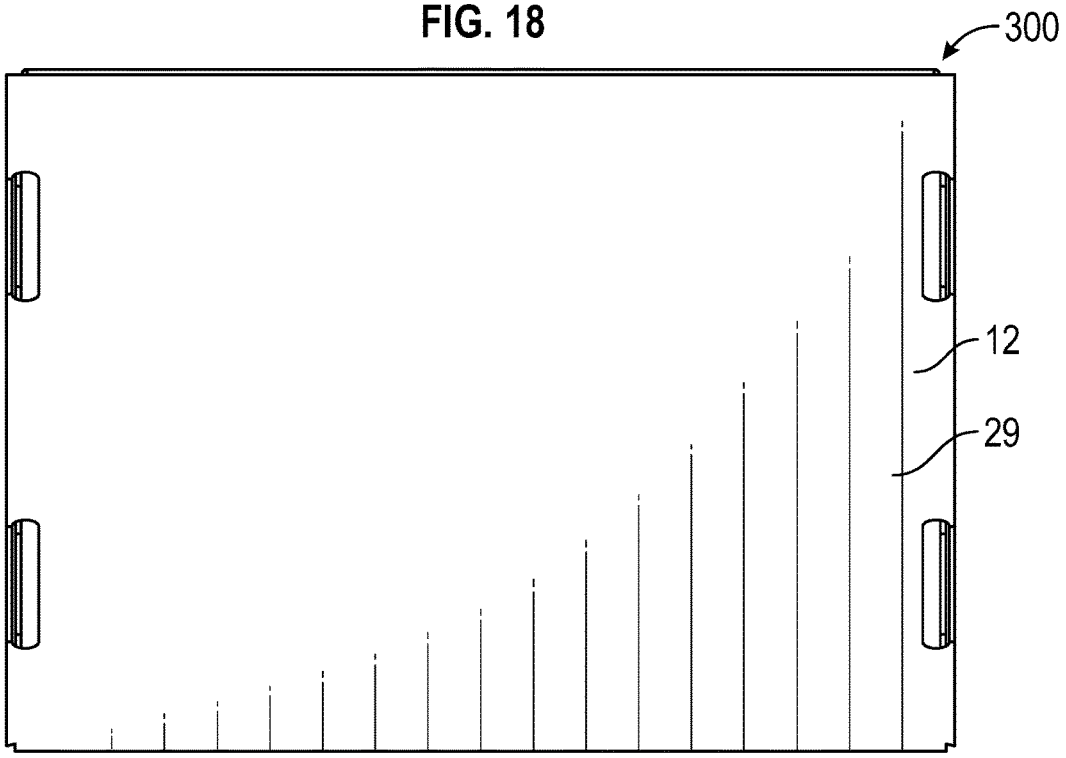
FIG. 19 is a bottom view of the box of FIG. 13.

Similar to the cover 14 of box 10 (FIGS. 1-10), a first side panel 338 can comprise a first panel portion 337 and a second panel portion (e.g., extension panel portion) 342 (FIG. 17) extending from the first panel portion 337 of the first side panel 338. The second panel portion 342 is arranged closer to a fold line 360 (FIG. 20) between the main panel 33 of the cover 14 and the rear wall 25 of the container portion 12 than the first panel portion 337 (e.g., the first panel portion 337 is arranged away from the fold line 360). A tab portion (e.g., tab or lifting tab) 344 can be coupled to the second panel portion 342 at a fold line 346 (FIGS. 18 and 20), and can extend from the second panel portion 342 at an angle and in a direction toward the second side panel 340 (FIG. 13). Thus, the tab portion 344 is arranged closer to an end of the cover 14 that is pivotably coupled to the container portion 12 than an opposite end of the cover 14 that is free (e.g., not directly coupled to the container portion 12).

A second side panel 340 can be configured similarly, with a first panel portion 347, a second (e.g., extension) panel portion 348, and a tab portion 350 coupled to the second panel portion 348 at a fold line 349 (FIGS. 13, 18, and 20) and extending from the second panel portion 348 in a direction toward the first side panel 338 (FIG. 13). The tab portion 350 is also arranged closer to the end of the cover 14 that is pivotably coupled to the container portion 12 than the opposite end of the cover 14 that is free.

A difference between the box 300 and the box 10 includes a shape of tab portions 344 and 350 of respective first and second side panels 338 and 340. As shown in FIG. 20, the fold lines 346 and 349 are curved (as compared to relatively straight fold lines 46 and 49 of box 10, as shown in FIG. 10).

In some embodiments, the fold line 346 curves toward an edge of the second panel portion 342 that is arranged closest to the fold line 360 between the cover 14 and the rear wall 25, from an outer edge of the second panel portion 342 to an inner edge of the second panel portion 342 that connects to the first panel portion 337. Similarly, in some embodiments, the fold line 349 curves toward an edge of the second panel portion 348 that is arranged closest to the fold line 360 between the cover 14 and the rear wall 25, from an outer edge of the second panel portion 348 to an inner edge of the second panel portion 348 that connects to the first panel portion 347.

This curvature of the fold lines 346 and 349 results in the free ends of the tab portions 344 and 350 being angled, in a horizontal plane that is parallel to the base wall 29, toward the front wall 24 and slightly away from the rear wall, when the cover 14 is open and the product platform 16 is in the second (presentation or display) position. As best shown in FIG. 13, the curved fold lines 346 and 349 also curve upwardly away from the container portion when the cover is open, increasing the height of the tab portions 344, 350 above the base wall when the cover is open. As a result, the product platform 16 may be lifted higher (e.g., further away from the base wall 29) in box 300 than box 10. Additionally, in certain embodiments the curvature of the fold lines 346 and 349 can provide increased folding memory or shape memory relative to straight fold lines. For example, in certain embodiments the curved fold lines can increase the tendency of the first and second tab portions 344 and 350 to move toward the straightened or unfolded state, where they extend outward from the corresponding second panel portions 342 and 348, as compared to relatively straight fold lines. As a result, the first tab portion 344 and the second tab portion 350 is likely to unfold, and/or can unfold or straighten to a greater degree, after a period of the box being closed, thereby increasing their ability to hold the product platform 16 in the raised, second configuration (e.g., as shown in FIG. 13). In certain embodiments, this can also improve the resilience and/or weight-bearing capability of the tab portions after repeatedly opening and closing the box.

As best shown in FIG. 20, the second tab portion 350 has a first (e.g., outer) edge 353 that is angled inwardly toward the cover 14 (e.g., toward the first panel portion 347 of the second side panel 340) and a second (e.g., inner) edge 351 that is arranged parallel to a longitudinal axis of the blank (and parallel to the fold line between the second side panel 340 and the main panel 33 of the cover 14. As shown in FIG. 20, the first and second edges of the first tab portion 344 have the same shape and angling as the second tab portion 350. In this way, axes of the tab portions 344 and 350, extending between the respective fold line 346 and 349 and their free end, are angled toward each other.

Further, in some embodiments, for all of the box embodiments disclosed herein, the fold lines (e.g., fold lines 346 and 349) between the respective tab portions (e.g., tab portions 344 and 350) and second panel portions (e.g., second panel portions 342 and 348) can be configured as relatively small creases (and not cut lines or perforations), thereby enabling the tab portions to reopen after insertion folding (of approximately 180 degrees), as occurs when the box is in the closed position (e.g., as shown in FIG. 6) and during an initial stage of lifting the cover and opening the box (e.g., as shown in FIG. 3).

As shown in FIG. 20, the tab portions 344 and 350 have free ends that are at least partially rounded. In alternate embodiments, the free ends of the tab portions 344 and 350 can have differently shaped free ends such as continuously curved (e.g., half-circle) or angled (e.g., similar to tab portions 44 and 50 of FIGS. 1-10), tapered, pointed, etc.

In certain embodiments, the box configurations described herein can comprise a single tab member. For example, with reference to the box 300 of FIGS. 13-20, in certain embodiments the box can comprise the tab 344 or the tab 350, which can have any length and can extend across any portion of the width dimension of the product platform.

Explanation of Terms

For purposes of this description, certain aspects, advantages, and novel features of the embodiments of this disclosure are described herein. The disclosed methods, apparatus, and systems should not be construed as being limiting in any way. Instead, the present disclosure is directed toward all novel and nonobvious features and aspects of the various disclosed embodiments, alone and in various combinations and sub-combinations with one another. The methods, apparatus, and systems are not limited to any specific aspect or feature or combination thereof, nor do the disclosed embodiments require that any one or more specific advantages be present or problems be solved.

Although the operations of some of the disclosed embodiments are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed methods can be used in conjunction with other methods.

As used in this disclosure and in the claims, the singular forms "a," "an," and "the" include the plural forms unless the context clearly dictates otherwise. Additionally, the term "includes" means "comprises." Further, the terms "coupled" and "associated" generally mean electrically, electromagnetically, and/or physically (e.g., mechanically or chemically) coupled or linked and does not exclude the presence of intermediate elements between the coupled or associated items absent specific contrary language.

In some examples, values, procedures, or apparatus may be referred to as "lowest," "best," "minimum," or the like. It will be appreciated that such descriptions are intended to indicate that a selection among many alternatives can be made, and such selections need not be better, smaller, or otherwise preferable to other selections.

In the description, certain terms may be used such as "up," "down," "upper," "lower," "horizontal," "vertical," "left," "right," and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object.

As used herein, the terms "box" and "container" refer to an article that is capable of holding one or more products or other physical articles. As used herein, the term "cardboard box" refers to a box formed from any of a variety of heavy paper-like materials (e.g., cellulosic fiber-based materials), including, for example, cardstock, corrugated fiberboard, and/or paperboard. As used herein, the term "corrugated fiberboard" refers to a fluted corrugated medium with one or more flat liner layers coupled thereto, such as a central corrugated layer with a first liner layer on one side and a second liner layer on another side of the central corrugated layer.

As used herein, the term "blank" refers to a flat sheet of material that is formed into a container, such as a flat sheet of corrugated paperboard. As used herein, the term "flat-formed" refers to an article that is manufactured from one or more flat pieces, such as a blank, that is manipulated into a different shape, such as by folding. As used herein, the terms "hingedly coupled" and/or "pivotably coupled" refers to any manner of engagement between a first part of a blank relative to a second part of the blank which allows the first part to travel relative to the second part without the first part becoming disengaged from the second part, such as by one or more fold lines, one or more cut lines, and/or some combination thereof. As used herein, the term "cut line" refers to an area that includes a cut that extends at least partially through the blank to facilitate folding, tearing, and/or some other structural advantage. Cut lines can be straight, curved, or some other shape, and can include perforation lines in which the cut is not continuous along the length of the cut line (i.e., a perforated line is a cut line that is discontinuous).

Unless otherwise indicated, all numbers expressing angles, dimensions, quantities of components, forces, moments, molecular weights, percentages, temperatures, times, and so forth, as used in the specification or claims are to be understood as being modified by the term "about." Accordingly, unless otherwise indicated, implicitly or explicitly, the numerical parameters set forth are approximations that can depend on the desired properties sought and/or limits of detection under test conditions/methods familiar to those of ordinary skill in the art. When directly and explicitly distinguishing embodiments from discussed prior art, the embodiment numbers are not approximates unless the word "about" is recited. Furthermore, not all alternatives recited herein are equivalents.

In view of the many possible embodiments to which the principles of the disclosed technology may be applied, it should be recognized that the illustrated embodiments are only examples and should not be taken as limiting the scope of the disclosure. Rather, the scope of the disclosure is at least as broad as the following claims. We therefore claim all that comes within the scope and spirit of these claims.

The invention claimed is:

1. A container, comprising:

a container portion comprising a plurality of walls;

a cover coupled to the container portion and configured to pivot between a closed position and an open position; and a product platform configured to receive a product, the product platform being coupled to the container portion and configured to pivot between a first position in which the product platform is received within the container portion and a second position in which the product platform is inclined at least partially out of the container portion;

wherein the cover is configured to engage the product platform such that when the cover is pivoted from the closed position to the open position in a first direction, motion of the cover pivots the product platform in a second direction from the first position to the second position such that the product platform is inclined at least partially out of the container portion at an angle relative to a base wall of the container portion, and wherein in the second position of the product platform, a rear of the product platform is accessible via spaces between the product platform and side walls of the container portion such that a product received by the product platform capable of being pushed outward and removed from the product platform.

2. The container of claim 1, wherein the cover comprises a tab portion positioned beneath the product platform when the product platform is moved from the first position to the second position and is in the second position and wherein the tab portion is configured to lift a free end portion of the product platform as the cover is pivoted to the open position.

3. The container of claim 2, wherein the tab portion is coupled to a panel portion of a side panel of the cover via a curved fold line and wherein, in the second position, the tab portion is angled more toward a front wall than a rear wall of the container portion.

4. The container of claim 2, wherein a first end portion of the product platform is pivotably coupled to a front wall of the product platform and a second end portion of the product platform rests against the tab portion when the product platform is in the second position and wherein, in the second position, the second end portion is raised relative to the first end portion.

5. The container of claim 2, wherein the tab portion is one of a pair of tab portions of the cover positioned beneath the product platform and wherein the pair of tab portions are configured to lift the free end portion of the product platform as the cover is pivoted to the open position.

6. The container of claim 1, wherein the product platform comprises a plurality of support panels that are folded over from a main panel of the product platform and are configured to extend downwardly, toward the base wall, and support the product platform when the product platform is in the first position and wherein the main panel of the product platform is configured to receive the product and configured to extend across an interior cavity defined by the plurality of walls of the container portion when the product platform is in the first position.

7. The container of claim 1, wherein the product platform comprises a central cavity disposed in a main panel of the product platform and a plurality of extension portions that are folded over from the main panel and are positioned around a perimeter of the central cavity, wherein the central cavity is configured to receive the product therein and the plurality of extension portions are configured to support the product within the central cavity.

8. The container of claim 1, wherein a plane defined by the product platform and a base plane, the base plane defined by the base wall of the container portion, form an angle of 30° to 60° when the product platform is in the second position.

9. The container of claim 1, wherein the product platform comprises a first end portion pivotably coupled to a front wall of the container portion and a free, second end portion, the free, second end portion comprising a support panel pivotable about a fold line defined on the product platform, between the support panel and a main panel of the product platform, the support panel being configured to support the free, second end portion of the product platform when the product platform is in the first position.

10. The container of claim 9, wherein the fold line between the main panel and the support panel is configured to maintain the support panel at an angle to the main panel of the product platform, the angle being in a range of 50° to 140°.

11. The container of claim 1, wherein the container portion comprises a front wall extending between two side walls of the container portion, wherein the front wall includes a central portion arranged between end portions of the front wall that are arranged adjacent to corresponding end portions of the two side walls, the central portion having a first height that is smaller than a second height of the end portions of the front wall, and wherein the product platform is pivotably coupled to the central portion of the front wall.

12. The container of claim 1, wherein the container is a one-piece, unitary construction.

13. A container, comprising:

a container portion comprising a plurality of walls defining an interior cavity;

a cover pivotably coupled to a rear wall of the container portion, the cover including two side panels arranged on opposite sides of the cover, at least one side panel of the two side panels including a tab portion that is configured to fold over and extend away from a remainder of the at least one side panel; and a product platform configured to receive a product, the product platform being pivotably coupled to a front wall of the container portion at a first end portion of the product platform and configured to pivot between a first position in which the product platform is disposed within the interior cavity of the container portion and a second position in which the product platform is inclined at least partially out of the interior cavity and a second end portion of the product platform, which is disposed opposite the first end portion, is arranged on top of the tab portion of the at least one side panel;

wherein the cover is configured to engage the product platform via the tab portion of the at least one side panel such that when the cover is pivoted from a closed position to an open position, motion of the cover pivots the product platform from the first position to the second position such that the product platform is inclined at least partially out of the interior cavity of the container portion at an angle relative to a base wall of the container portion.

14. The container of claim 13, wherein in the second position of the product platform, a rear of the product platform is accessible via spaces between the product platform and side walls of the container portion such that a product received by the product platform capable of being pushed outward and removed from the product platform without causing damage to the container or the product.

15. The container of claim 13, wherein the tab portion is coupled to a remainder of the at least one side panel via a curved fold line and wherein in the second position the tab portion is angled more toward the front wall than the rear wall of the container portion.

16. The container of claim 13, wherein the product platform comprises a main panel, a central cavity disposed within the main panel, the central cavity configured to receive the product therein, and a plurality of extension portions that are folded over from the main panel and are positioned around a perimeter of the central cavity, wherein each extension portion of the plurality of extension portions includes a first end connected to the main panel at a fold line and a free, second end that extends inward, into the interior cavity of the container portion, and wherein the free, second ends of the plurality of extension portions are angled toward one another, the plurality of extension portions configured to support the product within the central cavity.

17. The container of claim 13, wherein the product platform comprises a plurality of support panels that are folded over from a main panel of the product platform and are configured to extend downwardly, toward the base wall, and support the product platform when the product platform is in the first position.

18. The container of claim 17, wherein the plurality of support panels includes first and second support panels arranged on opposite sides of the main panel, the opposite sides extending between the first end portion and the second end portion of the product platform, and a third support panel extending across and folded over from the second end portion and pivotable about a fold line defined on the product platform, between the third support panel and the main panel of the product platform, wherein the fold line is configured to maintain the third support panel at an angle relative to the main panel such that the third support panel and the main panel are not arranged in a same plane, and wherein the third support panel is arranged above, relative to the base wall, the tab portion of each of the two side panels when the product platform is in the second position.

19. A container, comprising:

a container portion comprising a plurality of walls defining an interior cavity;

a cover pivotably coupled to a rear wall of the container portion, the cover including two side panels arranged on opposite sides of the cover, each side panel of the two side panels including a tab portion that is configured to fold over and extend away from a remainder of the side panel, the tab portion coupled to the remainder of the side panel via a curved fold line; and a product platform configured to receive a product within a central cavity of the product platform, the product platform being pivotably coupled to a front wall of the container portion at a first end portion of the product platform and configured to pivot between a first position in which the product platform is disposed within the interior cavity of the container portion and a second position in which the product platform is inclined at least partially out of the interior cavity of the container portion, and a second end portion of the product platform, which is disposed opposite the first end portion, engages and rests on the tab portion of each of the two side panels;

wherein the cover is configured to engage the product platform via the tab portion of each of the two side panels such that when the cover is pivoted from a closed position to an open position in a first direction, the tab portion of each of the two side panels lifts the second end portion of the product platform and motion of the cover pivots the product platform in a second direction from the first position to the second position such that the product platform is inclined at least partially out of the interior cavity of the container portion at an angle relative to a base wall of the container portion.

20. The container of claim 19, wherein, in the second position, for each of the two side panels, the tab portion is angled more toward the front wall than the rear wall of the container portion, and wherein the first direction is opposite the second direction.

21. The container of claim 19, wherein each side panel of the two side panels of the cover includes a first panel portion and a second panel portion extending from the first panel portion, the second panel portion arranged closer to a fold line between the cover and the rear wall of the container portion than the first panel portion, wherein the tab portion is coupled to the second panel portion via the curved fold line, and wherein the curved fold line curves toward an edge of the second panel portion that is arranged closest to the fold line between the cover and the rear wall, from an outer edge of the second panel portion to an inner edge of the second panel portion that connects to the first panel portion.

* * * * *